US006059603A

United States Patent [19]

Sato et al.

[11] Patent Number: 6,059,603

[45] Date of Patent: May 9, 2000

[54] TERMINAL PROCESSING STRUCTURE FOR A SEALED WIRE AND A TERMINAL PROCESSING METHOD FOR THE SAME

[75] Inventors: Kei Sato; Hiraji Takase, both of Shizuoka, Japan

[73] Assignee: Yazaki Corporation, Tokyo, Japan

[21] Appl. No.: 09/237,968

[22] Filed: Jan. 27, 1999

[30] Foreign Application Priority Data

Jan. 30, 1998 [JP] Japan ..... P 10-019709

[51] Int. Cl.[7] ..... H01R 13/00

[52] U.S. Cl. ..... 439/468; 439/582

[58] Field of Search ..... 439/468, 587, 439/589, 582

[56] References Cited

U.S. PATENT DOCUMENTS

| | | | |
|---|---|---|---|
| 4,892,491 | 1/1990 | Budano et al. | 439/582 |
| 5,263,877 | 11/1993 | Mitani | 439/585 |
| 5,429,529 | 7/1995 | Hashizawa et al. | 439/610 |
| 5,824,955 | 10/1998 | Saiso et al. | 174/88 R |
| 5,901,439 | 5/1999 | Endo et al. | 29/863 |

FOREIGN PATENT DOCUMENTS 6-349532 12/1994 Japan .

*Primary Examiner*—Neil Abrams
*Assistant Examiner*—Chandrika Prasad
*Attorney, Agent, or Firm*—Finnegan, Henderson, Farabow, Garrett & Dunner, L.L.P.

[57] ABSTRACT

A disclosed terminal processing structure for a sealed wire includes a terminal to which a core exposed by tearing off is to be connected, a connector housing in which the sealed wire is disposed with the core connected to the terminal and the braided wire exposed by tearing off, and a shielding wall disposed in the connector housing to shield and insulate between the core exposed by tearing off and the braided wire exposed by tearing off. Further, a disclosed terminal processing method for the sealed wire includes steps of preparing the sealed wire, preparing a terminal, exposing the core by tearing off, exposing the braided wire by tearing off, connecting the sealed wire to the terminal by connecting the core exposed by tearing off to the terminal, and providing the sealed wire connected to the terminal such that it is overlaid between a core accommodating hole of the connector housing and an outer cover accommodating hole of the connector housing so as to shield and insulate between the core exposed by tearing off and the braided wire exposed by tearing off by the shielding wall.

21 Claims, 19 Drawing Sheets

31a
29
25
20
28
31b
33
37a
34
15
22
24
36
32b
35
45
19
16
44

TERMINAL PROCESSING STRUCTURE FOR A SEALED WIRE AND A TERMINAL PROCESSING METHOD FOR THE SAME

BACKGROUND OF THE INVENTION

1. Field of the Invention

This invention relates to a terminal processing structure for a sealed wire and a terminal processing method for the same.

2. Description of the Related Art

Japanese Patent Application Laid-Open No. HEI 6-349532 has disclosed a terminal processing structure for a sealed wire.

According to the terminal processing structure for the sealed wire, the sealed wire is accommodated within a terminal accommodating chamber of a connector housing in a condition that a terminal is connected to a core of the sealed wire. A sealed terminal is attached in the connector housing and by inserting the sealed wire into the connector housing, its braided wire is connected to the sealed terminal.

A terminal processing method mentioned below is carried out on the sealed wire to connect such a braided wire to such a sealed terminal.

First of all, an insulation outer cover at the terminal end portion of the sealed wire is torn off to expose the braided wire and then the braided wire is inserted into a braided wire pressing member made of metallic ring.

Next, by sliding the braided wire pressing member toward the insulation outer cover of the sealed wire, the exposed braided wire is contracted.

Next, the sealed wire is inserted into a shield tube so as to sandwich the contracted braided wire. This insertion is carried out so that the shield tube is overlaid between an insulating inner cover and the insulating outer cover positioned on both sides of the braided wire in the axial direction of the sealed wire.

After that, by crimping the shield tube, the braided wire is brought into contact with the shield tube.

Finally, by inserting the shield tube into the terminal accommodating chamber with this condition, the shield tube comes into contact with the shield terminal so as to achieve connection between the braided wire and the sealed terminal.

However, in this terminal processing method, the braided wire pressing member is necessary for blocking the braided wire extending in the direction of the core from contacting the core, and therefore the number of necessary parts has increased.

Further, because the braided wire pressing member is required to be slid so as to contract the braided wire after the sealed wire is inserted in the braided wire pressing member, the installation procedure is complicated and troublesome.

Further, because the braided wire pressing member and shield tube must be selected depending on the size of the sealed wire, this method is not versatile and an appropriate selection regarding the braided wire pressing member and shield tube is very troublesome.

SUMMARY OF THE INVENTION

An object of the present invention is to provide a terminal processing structure for a sealed wire and a terminal processing method for the same which are capable of preventing a contact between a braided wire and a core of the sealed wire by a simple structure and simple operation and can be applied substantially irrespective of the size, typically, the thickness of the sealed wire.

Here, the sealed wire typically has a core, an insulating inner cover for covering the core, a braided wire disposed around the insulating inner cover and an insulating outer cover for covering the braided wire.

In order to achieve the above object, the present invention relating to a terminal processing structure for a sealed wire includes a terminal to which the core exposed by tearing off the insulating inner cover is to be connected, a connector housing in which the sealed wire is disposed with the core connected to the terminal and the braided wire exposed by tearing off the insulating outer cover, and a shielding wall disposed in the connector housing to shield and insulate between the core exposed by tearing off the insulating inner cover and the braided wire exposed by tearing off the insulating outer cover.

According to such a structure, by installing the sealed wire in which the core is uncovered into the connector housing, the shielding wall of the connector housing shields the uncovered braided wire from the uncovered core. Thus, the braided wire dose not come into contact with the core, thereby achieving secure insulation.

Further, because the shielding wall for carrying out insulation can be formed with the connector housing at the time of forming of the connector housing, a processing for that forming becomes unnecessary, so that the connector housing and shielding wall can be formed easily.

Still further, the insulation with the shielding wall can be carried out at the same time as the installation of the sealed wire into the connector housing. No special processing or treatment is necessary for the braided wire, insulating inner cover and insulating outer cover, so that the insulation between the braided wire and core can be carried out easily and rapidly.

More concretely speaking, preferably, the connector housing further has a core accommodating hole for accommodating the core exposed by tearing off the insulating inner cover and an outer cover accommodating hole for accommodating the insulating outer cover, and the shielding wall is disposed between the core accommodating hole and the outer cover accommodating hole.

Because in this structure, the shielding wall is provided between the core accommodating hole and the outer cover accommodating hole, the braided wire and the shielding wall are located securely between the core and the insulating outer cover so as to prevent the braided wire from coming into contact with the core.

More concretely speaking, preferably, the shielding wall is firmly in contact with a periphery of an end portion of the insulating inner cover and/or a periphery of an end portion of the insulating outer cover.

Because the shielding wall is firmly in contact with the periphery of the end portion of the insulating inner cover and/or the periphery of the end portion of the insulating outer cover, the sealed wire is blocked from moving in the axial direction thereof within the connector housing. Thus, the movement of the braided wire in the axial direction is eliminated so as to prevent the braided wire from contacting the core. Particularly because the shielding wall is firmly in contact with the periphery of the end portion of the insulating inner cover, the braided wire can not surpass the insulating inner cover. This makes it possible to prevent the contact between the insulating inner cover and the core.

Here, the shielding wall preferably have a tapered shape whose diameter continuously decreases from the outer cover accommodating hole to the core accommodating hole. Or the shielding wall may have a staircase shape whose diameter stepwise decreases from the outer cover accommodating hole to the core accommodating hole.

Because the shielding wall is firmly in contact with the peripheries of the end portion of the insulating inner cover and/or the periphery of the end portion of the insulating outer cover, the sealed wire is blocked from moving in the axial direction thereof within the connector housing. Thus, the movement of the braided wire in the axial direction is eliminated so as to prevent the braided wire from contacting the core. Particularly because the shielding wall is firmly in contact with the periphery of the end portion of the insulating inner cover, the braided wire can not surpass the insulating inner cover. This makes it possible to prevent the contact between the insulating inner cover and the core.

Further, in such a staircase shaped shielding wall, its any corresponding one of the steps comes into contact with the insulating inner cover of the sealed wire and/or the insulating outer cover thereof. Then, the step in contact insulates between the braided wire and the core. Because this structure allows any step to come into contact with the insulating outer cover and/or the insulating inner cover, even if there is any deviation of dimension between the sealed wire and the shielding wall, the insulation between the braided wire and the core can be secured.

If more concretely speaking, preferably, the sealed wire to be used includes a plurality of sealed wires varying in thickness, the diameter of the core accommodating hole corresponds to a maximum value of the diameter of the core in the plurality of the sealed wires to be installed into the connector housing, the diameter of the outer cover accommodating hole corresponds to a maximum value of the diameter of the insulating outer cover in the plurality of the sealed wires to be installed into the connector housing, and the tearing length of the insulating inner cover and/or the tearing length of the insulating outer cover are adjusted corresponding to the thickness of the plurality of the sealed wires.

Because in such a structure, the diameters of the core accommodating hole and the outer cover accommodating hole are determined to meet the maximum thickness of the sealed wire, the sealed wires of any thickness can be installed therein so as to improve the versatility. Further, because the insulating inner cover and/or insulating outer cover come into contact with the shielding wall by adjusting the uncovering length of the sealed wire, the braided wire is shielded from the core as for the sealed wire of any diameter. Thus, the insulation between the braided wire and the core can be achieved.

If more concretely speaking, preferably, the shielding wall has protrusions biting in an peripheral surface of the insulating inner cover and/or a peripheral surface of the insulating outer cover, or preferably, a face of the protrusion on the side of the insulating outer cover is inclined.

With such a structure, the protrusions bite in the insulating outer cover and/or the insulating inner cover so as to prevent a deviation of the position of the sealed wire. Thus, the sealed wire can be installed securely into the connector housing. Further, because the sealed wire is not deviated, the contact between the braided wire and the core is eliminated.

Further because the protrusion is inclined in the direction of blocking the sealed wire from slipping out, the protrusion prevents the sealed wire from being deviated in the direction in which it slips out. Thus, the slippage of the sealed wire is eliminated and further the sealed wire is not deviated. As a result, the contact between the braided wire and the core due to the deviation of the sealed wire can be prevented.

If more concretely speaking, preferably, the connector housing is formed of a main unit having a lower half of the shielding wall and a cover having a upper half of the shielding wall and to be put on the main unit.

With such a structure, the sealed wire is installed into the main unit with the cover open, and after that, by closing the cover, the shielding wall is formed by the cover and the main unit so as to achieve insulation between the braided wire and the core. Thus, the sealed wire can be installed into the connector housing easily.

If more concretely speaking, preferably, the sealed terminal has an elastic contact piece elastically in contact with a mating tab terminal of a mating connector which the connector housing engages. Here, the connector housing has contact adjusting walls for avoiding a contact between the elastic contact piece and the mating tab terminal in a case of incomplete engagement with the mating connector and for permitting a contact between the elastic contact piece and the mating tab in a case of complete engagement with the mating connector.

In such a contact adjusting wall, when the connector housing is not completely fit to the mating connector, the elastic contact piece is not in contact with the mating tab terminal. Only when the connector housing is completely fit to the mating connector, the elastic contact piece is in contact with the mating tab terminal. Therefore, depending on whether or not the complete fitting to the mating connector is carried out, it is possible to detect whether or not the sealed terminal is in contact with the mating tab terminal.

If more concretely speaking, preferably, the terminal is disposed in the connector housing in a direction perpendicular to an installation direction of the sealed wire.

With such a structure, the terminal connected to the core is in perpendicular to the installation direction of the sealed wire. Thus, the connector housing for accommodating those has a bent structure having an angle. Therefore, the connector housing is not extended, so that the connector housing can be installed in a small space easily.

If more concretely speaking, preferably, the braided wire and the sealed terminal are conductively connected to each other by applying ultrasonic vibration to the insulating outer cover from outside of the connector housing.

Because the insulating outer cover is melted by ultrasonic vibration applied from outside of the connector housing so that the inside braided wire is connected to the sealed terminal, crimping and the like for connecting them becomes unnecessary, so that the connection therebetween can be carried out easily. Further, by ultrasonic vibration from outside of the connector housing, the operability for the connection is improved.

On the other hand, a terminal processing method for a sealed wire includes a step of preparing the above typically constructed sealed wire, a step of preparing a terminal, a step of exposing the core by tearing off the insulating inner cover of the sealed wire, a step of exposing the braided wire by tearing off the insulating outer cover of the sealed wire, a step of connecting the sealed wire to the terminal by connecting the core exposed by tearing off the insulating inner cover to the terminal, and a step of providing the sealed wire connected to the terminal such that the shield wire is overlaid between a core accommodating hole of the connector housing and an outer cover accommodating hole of the connector housing so as to shield and insulate between the core exposed by tearing off the insulating inner cover and the braided wire exposed by tearing off the insulating outer cover.

According to this method, when installing the sealed wire in which the core is exposed by tearing off into the connector housing, the shielding wall insulates between the braided wire at the uncovered portion and the core. Thus, the insulation therebetween can be achieved by a simple operation.

Further, preferably, the terminal processing method further comprises a step of adjusting the tearing length of the insulating inner cover and/or the tearing length of the insulating inner cover corresponding to the thickness of the sealed wire.

Because the insulating inner cover and/or the insulating outer cover come into contact with the shielding wall by adjusting the tearing lengths of the insulating inner cover and/or the insulating outer cover, the insulation between the braided wire and the core can be achieved regarding the sealed wire having any diameter.

DETAILED DESCRIPTION OF THE PREFERRED EMBODIMENTS

Figure 1:
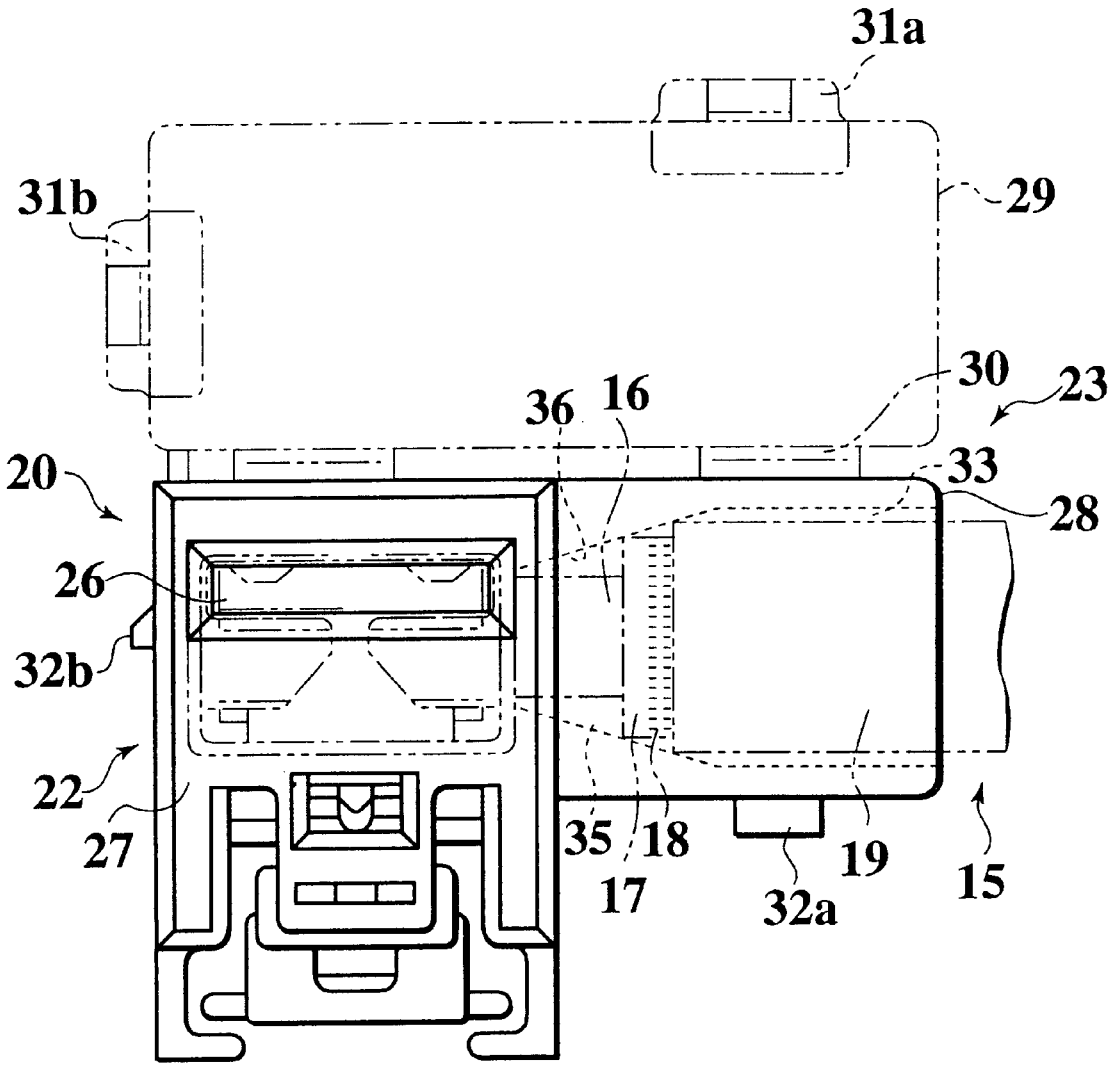
FIG. 1 is a front view of a connector housing in which a sealed wire is installed according to the first embodiment of a terminal processing structure for a sealed wire and terminal processing method for the same of the present invention.
Figure 2:
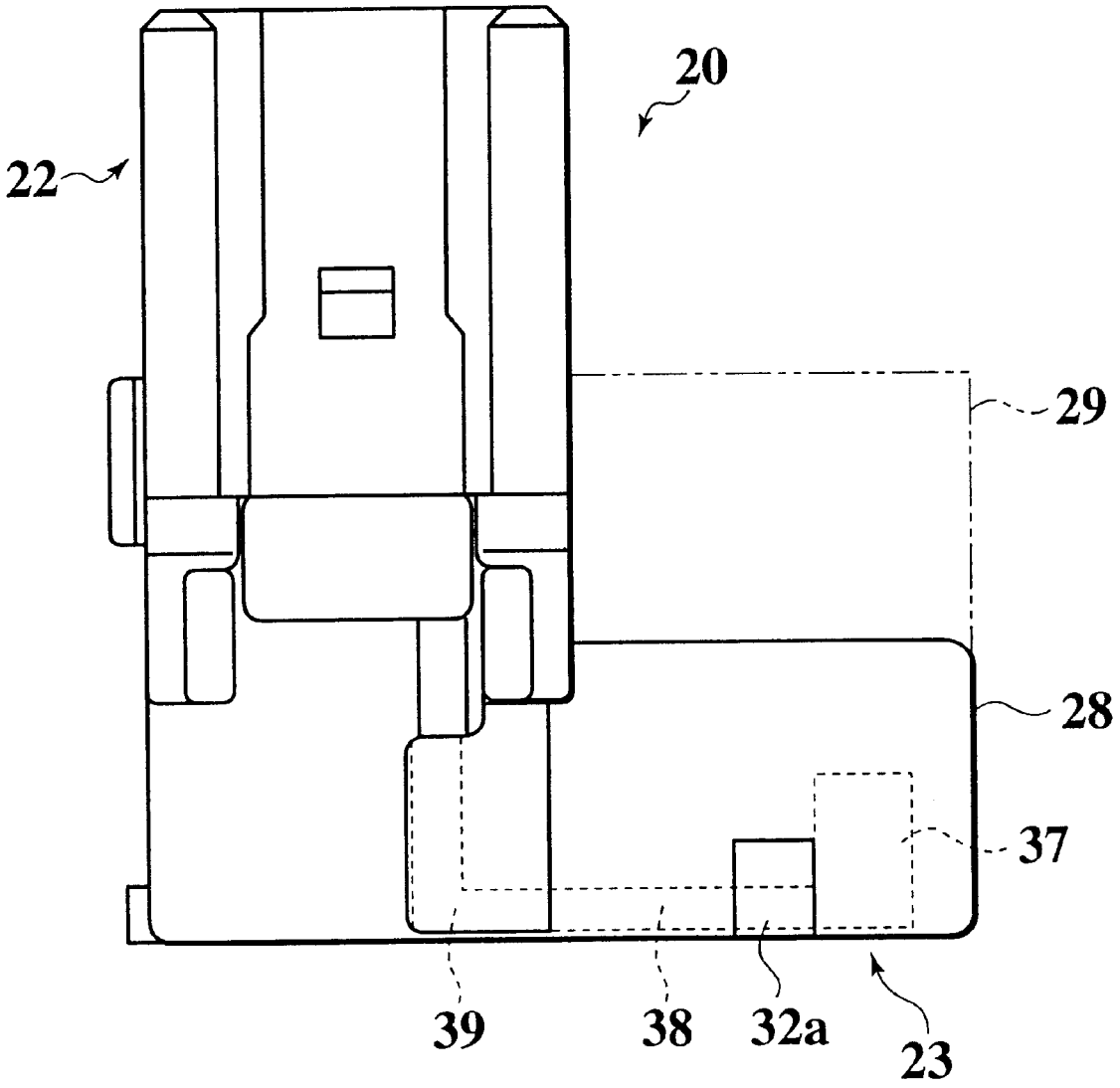
FIG. 2 is a bottom view of FIG. 1 of the connector housing according to the same embodiment.
Figure 3:
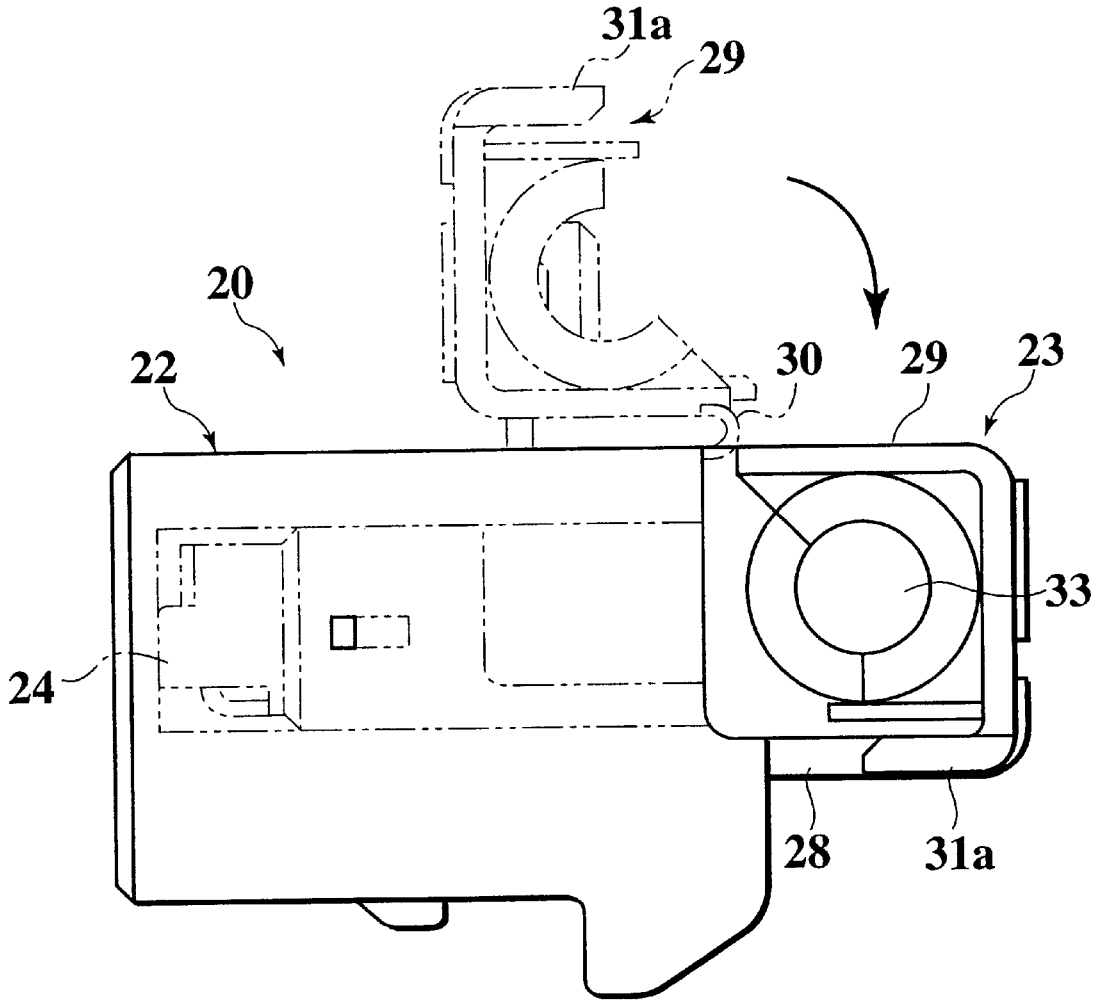
FIG. 3 is a right side view of FIG. 1 showing opening and closing of a cover in the connector housing of the same embodiment.
Figure 4:
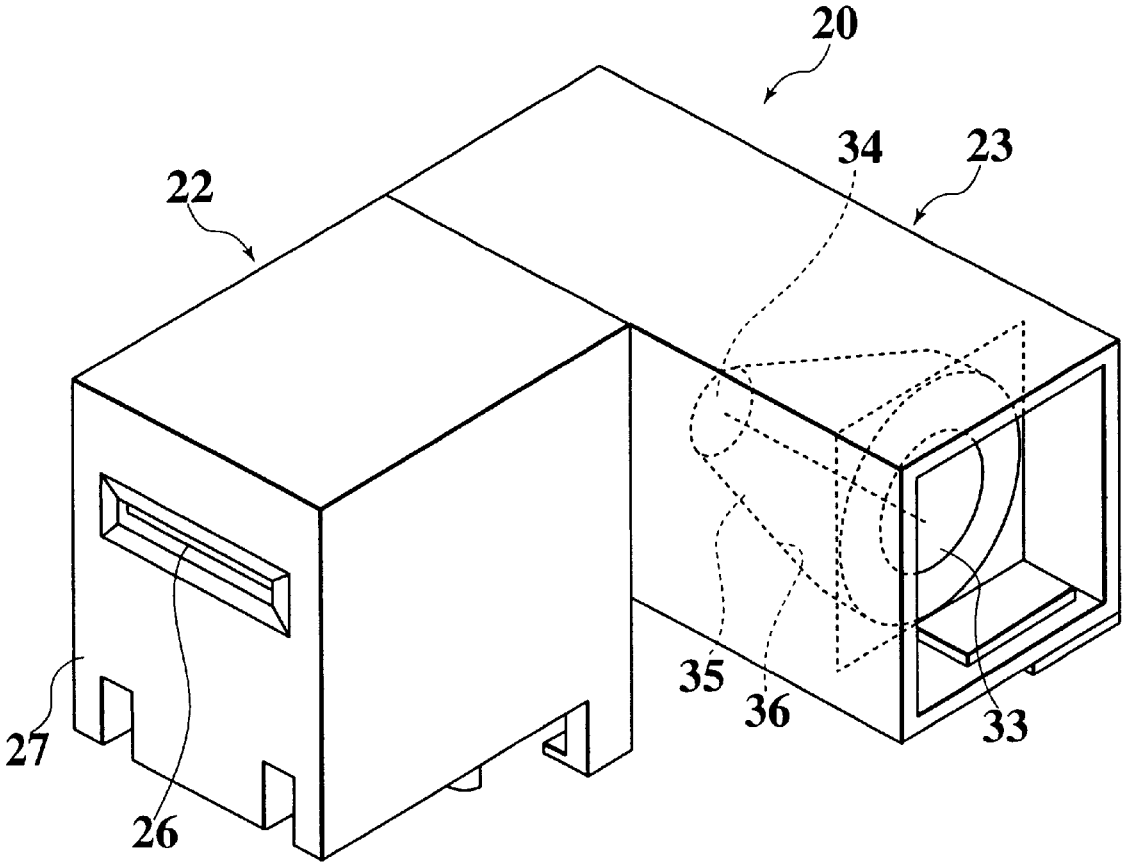
FIG. 4 is a perspective view of the connector housing with the cover closed according to the same embodiment.

Hereinafter, each of embodiments of the present invention will be described in detail with reference to the accompanying drawings. In following respective embodiments, the same reference numeral is made to correspond to substantially the same component.

Referring to FIGS. 1 to 11, a first embodiment of the terminal processing structure for the sealed wire and terminal processing method for the same will be described.

The terminal processing structure of this embodiment includes a so-called sealed wire 15, connector housing 20 and sealed terminal 24.

Figure 10A:
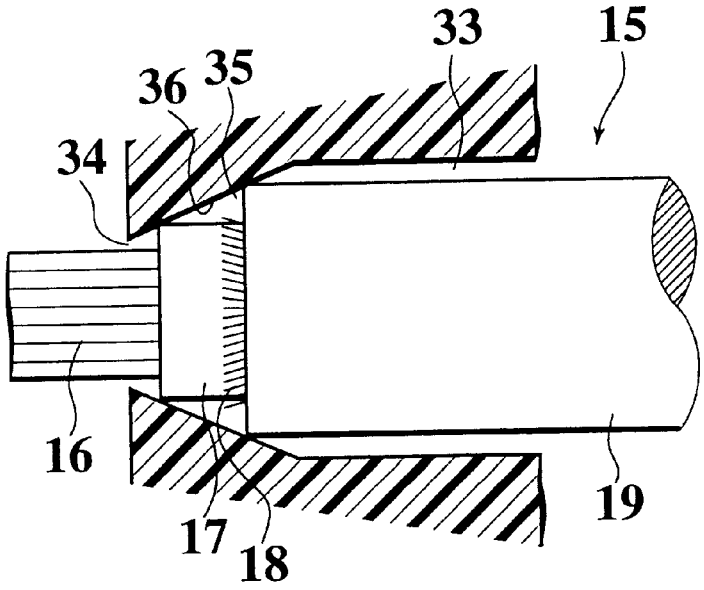
FIG. 10A is a partial sectional view showing a state of the sealed wire in the connector housing according to the same embodiment.
Figure 10B:
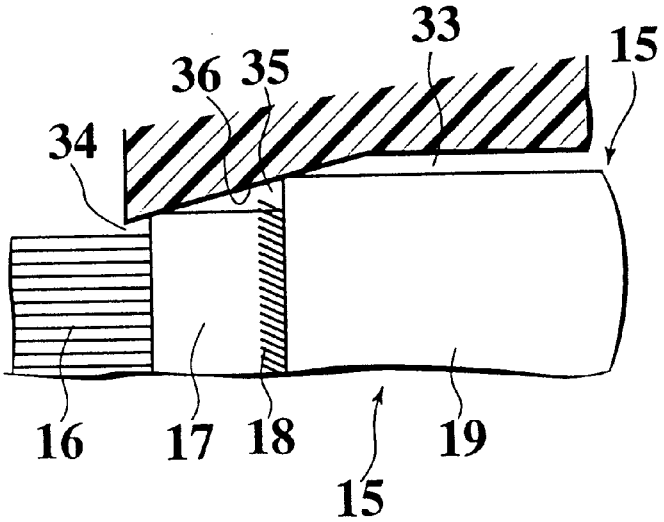
FIG. 10B is a partially enlarged sectional view showing a state of the sealed wire in the connector housing according to the same embodiment.

More concretely, as understood from reference to FIGS. 10A and 10B, typically, the sealed wire 15 comprises a core 16, an insulating inner cover 17 for covering the core 16, a braided wire 18 disposed around the insulating inner cover 17, and an insulating outer cover 19 for covering the core 16, insulating inner cover 17 and braided wire 18. By tearing off the insulating outer cover 19 and insulating inner cover 17 to expose the core 16, this sealed wire 15 is subjected to terminal processing with the exposed core 16 connected to a terminal 24.

As understood from reference to FIGS. 1 to 9, a connector housing 20 is formed such that a terminal accommodating portion 22 and a wire accommodating portion 23 intersect each other and are integrated with each other.

Because the terminal accommodating portion 22 and wire accommodating portion 23 are constructed so as to intersect each other, the overall length of the connector housing 20 is not so long so that it can be disposed at a narrow space.

Figure 5:
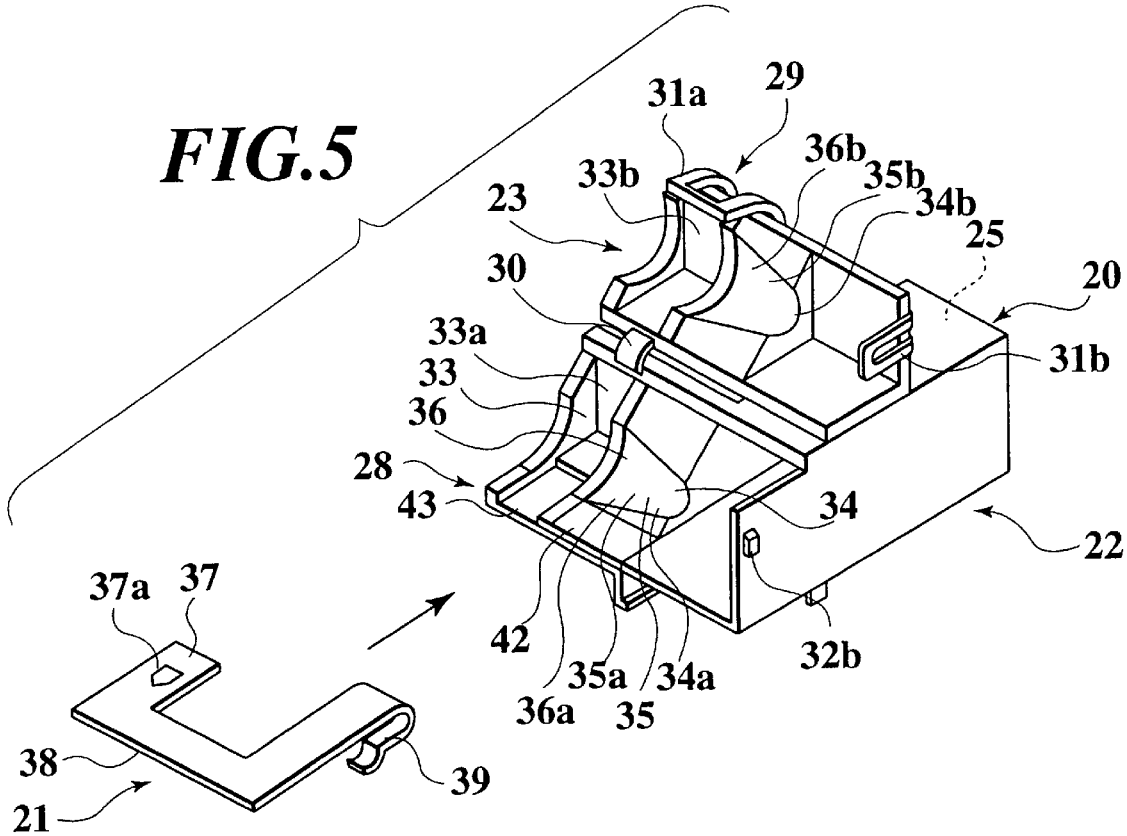
FIG. 5 is a disassembly perspective view showing a state in which a sealed terminal is disposed in the connector housing with the cover opened according to the same embodiment.
Figure 6:
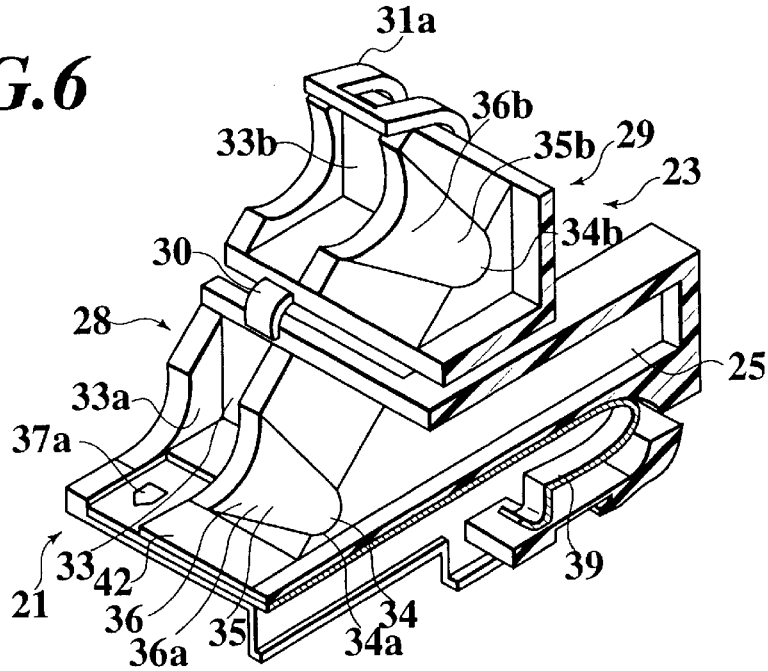
FIG. 6 is a perspective view including a part of cross section showing a state in which the sealed terminal is attached to the connector housing according to the same embodiment.
Figure 7:
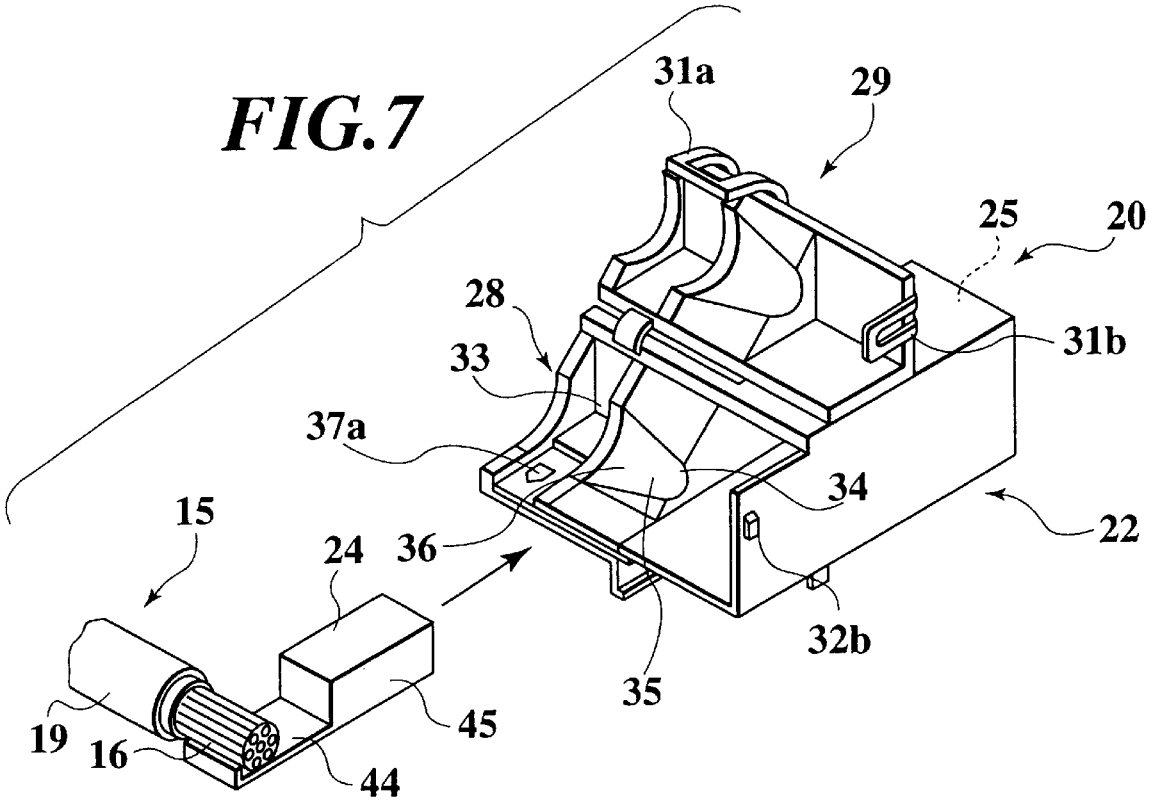
FIG. 7 is a disassembly perspective view showing a state in which the sealed wire to which a terminal is connected is disposed in the connector housing according to the same embodiment.

As understood from reference to FIGS. 5 to 7, the terminal accommodating portion 22 comprises a terminal accommodating chamber 25 for accommodating the terminal 24 connected to the core 16 of the sealed wire 15. As understood from reference to FIGS. 1 and 4, a front wall 27 of the terminal accommodating portion 22 has a terminal insertion window 26 through which a terminal (not shown) of a mating connector can be inserted.

On the other hand, the wire accommodating portion 23 accommodates the sealed wire 15, and as shown in FIGS. 5 to 7, typically comprises a main unit 28 and a cover 29 to be put over the main unit 28.

As understood from reference to FIGS. 1 to 7, 9 and the like, the main unit 28 and the cover 29 are formed so that their rectangular cylinders are cut obliquely to halves, and by putting the cover 29 on the main unit 28, their half cut portions are butted to each other so as to form the rectangular cylindrical shaped wire accommodating portion 23. Here, the cover 29 is linked to the main unit 28 via a hinge 30 and by rotating the cover 29 around the hinge 30, the main unit 28 can be opened and closed. Because the cover 29 is closed relative to the main unit 28, the cover 29 and main unit 28 have hook pieces 31*a*, 31*b* and hook protrusions 32*a*, 32*b*, respectively, which removably engage with each other.

Within the wire accommodating portion 23, an outer cover accommodating hole 33 for accommodating the insulating outer cover 19 of the sealed wire 15 and cover accommodating hole 33 for accommodating the core 16 are formed.

The outer cover accommodating hole 33 is a relatively large hole portion and the core accommodating hole 34 is a relatively small hole portion. According to this embodiment, the outer cover accommodating hole 33 extends at a predetermined length in the axial direction of the sealed wire 15 and each of both end portions thereof have a wall portion along a shape of the insulating outer cover. In the embodiment, at the middle portion thereof, a wall portion along the shape of the insulating outer cover is not formed. Also, the core accommodating hole 34 does not extend in the axial direction of the sealed wire 15 so long. Of course, in this embodiment the length of the core accommodating hole 34 and that of the wall portion of the outer cover accommodating hole 33 can be set appropriately depending on needs. For example, it is permissible to form a wall portion at the middle portion of the outer cover accommodating hole 33 or it is permissible to form a portion extending along the axial direction in the core accommodating hole 34.

Further, in the embodiment, a communicating hole 35 is formed between the outer cover accommodating hole 33 and core accommodating hole 34. The wall portion for forming the communicating hole 35 is formed of a shielding wall 36. The shielding wall 36 is formed in a tapered shape such that a side thereof on the outer cover accommodating hole 33 has a large diameter and the diameter continuously decreases toward the core accommodating hole 34. By forming such a tapered shape, as described later, the braided wire 18 at its uncovered portion can be securely caught within the communicating hole 35 so as to prevent the braided wire 18 from coming near the core 16 and contacting it.

Because the wire accommodating portion 23 is formed by the main unit 28 and cover 29 which are in half cut condition, when the main unit 28 and cover 29 are not closed, the outer cover accommodating hole 33, the core accommodating hole 34 and the communicating hole 35 are each in half cut condition.

That is, as understood from reference to FIGS. 5 and 6, reference numerals 33*a*, 34*a* and 35*a* designate portions in half cut condition of the outer cover accommodating hole 33, core accommodating hole 34 and communicating hole 35 formed on the side of the main unit 28, namely, the half cut portions. Reference numerals 33*b*, 34*b* and 35*b* designate portions in half cut condition of the outer cover accommodating hole 33, core accommodating hole 34 and communicating hole 35 formed on the side of the cover 29 so as to correspond thereto, namely the half cut portion. In FIGS. 5 and 6, reference numeral 36*a* designates a half cut portion of the shielding wall 36 formed on the side of the main unit 28 and reference numeral 36*b* designates a half cut portion of the shielding wall 36 formed on the side of the cover 29.

The main unit 28 and the cover 29 are formed with resin in each resin molding die and the outer cover accommodating hole 33, core accommodating hole 34, communicating hole 35 and shielding wall 36 are formed so that each of them is integrated when they are linked with the hinge 30. Thus, these components can be formed simply.

As shown in FIG. 5, the sealed terminal 21 is made of metal formed in a flat U-shape. One end of the sealed terminal 21 is a flat contact portion 37 having a protruded contact element 37*a*. This contact portion 37 connects to a linked portion 38 provided sideways and an elastic contact piece 39 is provided at a front end of the linked portion 38. Then, the contact element 37*a* is to be connected to the braided wire 18 of the sealed wire 15 and this connection is achieved by use of ultrasonic vibration applied to the insulating outer cover 19 as described later. As shown in detail in FIGS. 11A to 11C, a tab terminal 41 of a mating connector 40 comes into contact with the elastic contact piece 39 so that it is connected to the tab terminal 41.

The sealed terminal 21 is installed to the main unit 28 of the wire accommodating portion 23. Concretely, the linked portion 38 of the sealed terminal 21 is nipped by a bottom face 42 of the main unit 28. In this nipping state, the elastic contact piece 39 is located below the terminal accommodating chamber 25. Further, the contact portion 37 is supported by a supporting concave portion 43 formed in the main unit 28 and fixed on the supporting concave portion 43. The supporting concave portion 43 is provided so as to be located corresponding to the outer cover accommodating hole 33.

Next, a terminal processing method of this embodiment will be described.

As for the sealed terminal 21, as shown in FIG. 5, with the cover 29 of the connector housing 20 open, the contact portion 37 and elastic contact piece 39 are brought near the connector housing 20 in the direction of an arrow so as to set the sealed terminal 21 in the main unit 28 of the connector housing 20. By this setting, as shown in FIG. 6, the contact portion 37 of the sealed terminal 21 is fixed to the supporting concave portion 43 and the elastic contact piece 39 is located below the terminal accommodating chamber 25.

On the other hand, as for the sealed wire 15, as shown in FIG. 7, the insulating outer cover 19 and insulating inner cover 17 are previously torn off so as to expose the core 16, and a connection portion 44 of the terminal 24 is connected to the exposed core 16 by soldering. In FIG. 7, reference numeral 45 denotes a contact portion, which is provided aside the connection portion and which a mating terminal (not shown) contacts. This terminal 24 is connected to the sealed wire 15 such that a length direction of the terminal 24 is perpendicular to a length direction of the sealed wire 15. At this stage, by uncovering the sealed wire 15, the braided wire 18 is partially exposed from the insulating outer cover 19. No treatment is needed as for the exposed braided wire 18.

Then, using the sealed wire 15 connected in the above manner, the terminal 24 is inserted into the terminal accommodating chamber 25. By this insertion, the sealed wire 15 is disposed such that it is overlaid along the outer cover accommodating hole 33 and core accommodating hole 34. That is, the insulating outer cover 19 is located corresponding to the outer cover accommodating hole 33, the core 16 is located corresponding to the core accommodating hole 34, and the insulating inner cover 17 and the partially exposed braided wire 18 at the above described uncovered portion are located corresponding to the communicating hole 35. Here, the contact element 37*a* of the sealed terminal 21 lies at the insulating outer cover 19.

Figure 8:
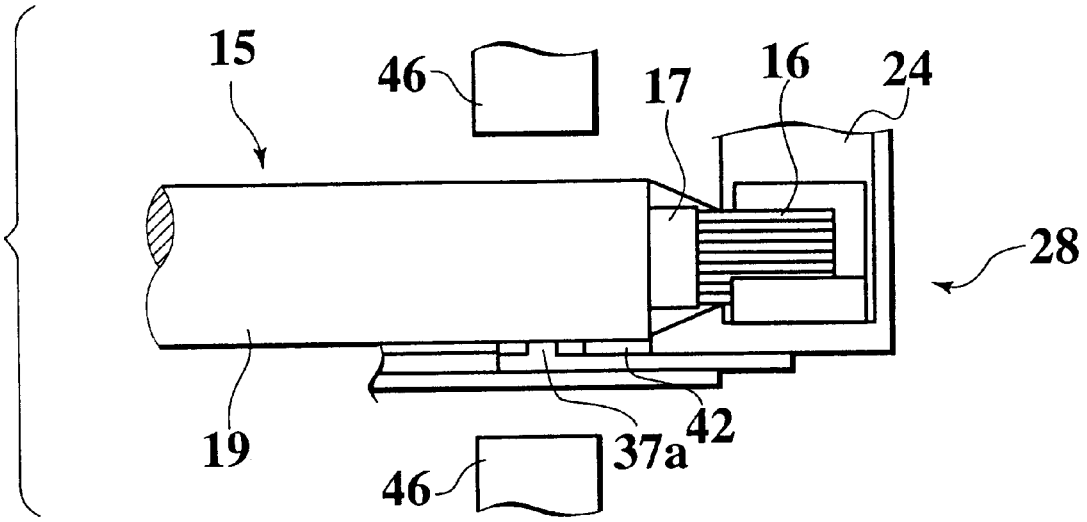
FIG. 8 is a sectional view for connecting a braided wire of the sealed wire to a contact piece of a sealed terminal by ultrasonic vibration according to the same embodiment.

After that, the braided wire 18 is coupled with the sealed terminal 21. Concretely, as shown in FIG. 8, this coupling is carried out by applying ultrasonic vibration on a portion in which the contact portion 37 of the sealed terminal 21 lies at the insulating outer cover 19 by using ultrasonic horns 46. That is, the ultrasonic horns 46 are opposed just like to sandwich the sealed wire 15 from up and down outside the main unit 28 and in this opposing state, the ultrasonic vibration is applied. By this ultrasonic vibration, the insulating outer cover 19 is partially melted so that the interior braided wire 18 is exposed. As a result, this exposed portion is connected to the contact element 37*a* and its neighborhood. Because a necessity of removing the insulating outer cover 19 to expose the braided wire 18 does not exist in this connection, the braided wire 18 can be connected easily, so that the terminal processing can be carried out rapidly.

The connection between the braided wire 18 and sealed terminal 21 can be also achieved by melting by heating with a soldering iron or the like. The contact element 37*a* of the contact portion 37 is provided so as to protrude toward the sealed wire 15. In addition, in case the insulating outer cover 19 is sufficiently melted thereby securing a sufficient bonding strength relative to the braided wire 18, it is possible to eliminate the existence of such a contact element 37*a*.

Figure 9:
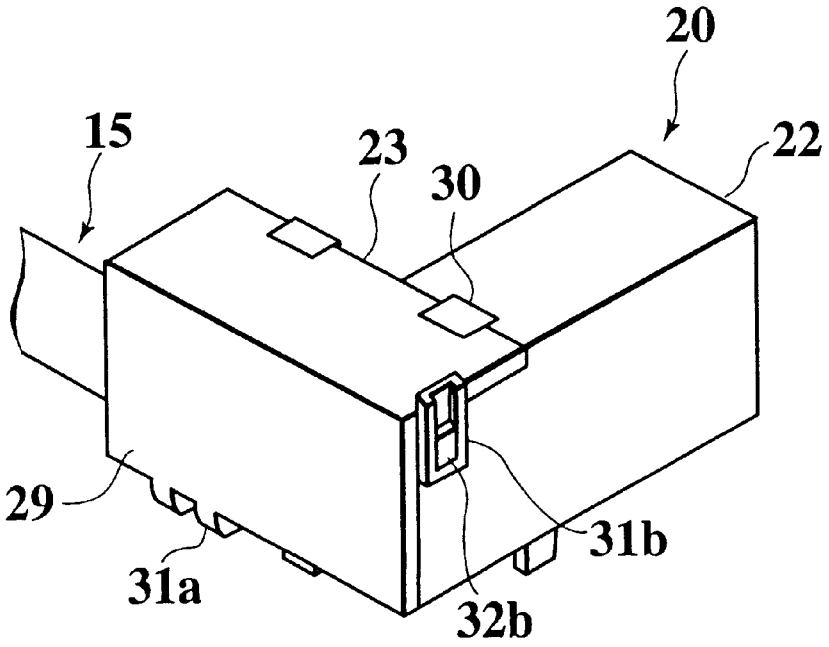
FIG. 9 is a perspective view of the connector housing in a state in which the cover is closed after the sealed wire is attached.

Finally, after such connection is made, the cover 29 is closed to respectively engage the hook pieces 31*a* and 31*b* with the hook protrusions 32*a* and 32*b*, so that as shown in FIG. 9, the cover 29 is coupled with the main unit 28.

By closing the cover 29 as described above, the shielding wall 36 is formed so as to surround the communicating hole 35. As shown in FIGS. 10A and 10B, the shielding wall 36 is firmly in contact with a periphery of an end of the insulating inner cover 17 and depending on the case, in contact with a periphery of an end of the insulating outer cover 19. That is, even if the periphery of the end of the insulating inner cover 17 is capable of advancing to the left in the same figures to the maximum extent, it can only advance up to just before the core accommodating hole 34. As a result, the braided wire 18 exposed at the uncovered portion is blocked by the shielding wall 36 so that the braided wire 18 does not arrive at the core accommodating hole 34, thereby eliminating an inconvenience in the case that the braided wire 18 contacts the core 16. In FIGS. 10A and 10B, it is expressed that a peripheral wall portion 36 is firmly in contact with both the periphery of the end of the insulating inner cover 17 and the periphery of the end of the insulating outer cover 19.

In this embodiment, as described above, the shielding wall 36 is formed only by closing the cover 29, so that the braided wire 18 exposed at the uncovered portion can be contained within the communicating hole 35. For the reason, a troublesome processing of fitting a metallic ring to the braided wire 18 to prevent a contact with the core 16 becomes unnecessary, so that the insulation between the braided wire 18 and core 16 can be carried out simply and securely.

Finally, a procedure for engaging a connector produced in the above processing with a mating connector will be described.

Figure 11A:
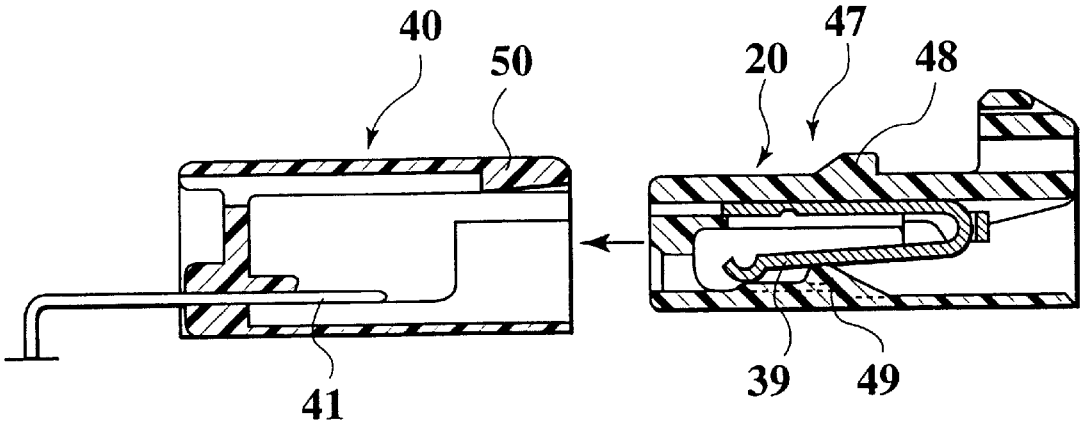
FIG. 11A is a sectional view showing a state prior to fitting of a connector after assembly to a mating connector according to the same embodiment.
Figure 11B:
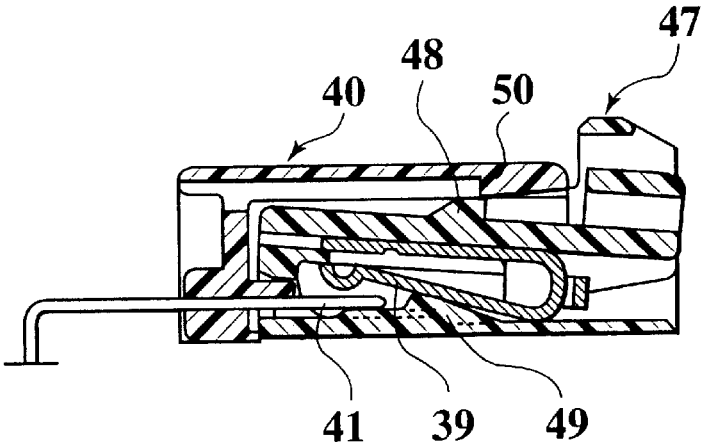
FIG. 11B is a sectional view showing a state halfway of fitting of the connector after assembly to the mating connector according to the same embodiment.
Figure 11C:
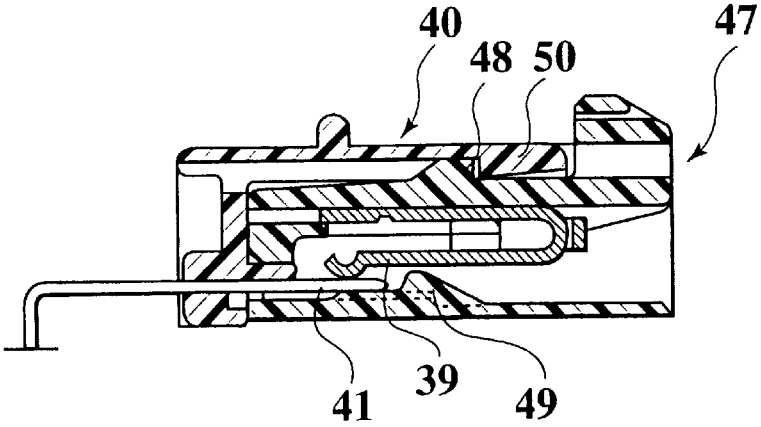
FIG. 11C is a sectional view showing a state in which the connector after assembly is completely fit to the mating connector according to the same embodiment.

FIGS. 11A to 11C show an example of the procedure for engaging the connector 47 produced in the above processing with the mating connector 40.

In the connector 47, as shown in detail in FIG. 11A, a first contact adjusting wall 48 and a second contact adjusting wall 49 are formed. The first contact adjusting wall 48 is formed so as to protrude from the top surface of the connector housing 20 and the second contact adjusting wall 49 is formed so as to protrude within the connector housing 20. The first contact adjusting wall 48 is fitted to the mating connector 40 and the second contact adjusting wall 49 is provided to be located just below the first contact adjusting wall 48 and the elastic contact piece 39 of the sealed terminal 21 is elastically in contact therewith.

First of all, the connector 47 is moved toward the mating connector 40 as indicated by an arrow.

Then, as shown in FIG. 11B, in an initial state in which the fitting is incomplete, the first contact adjusting wall 48 is in contact with a top inner wall 50 of the mating connector 40 so that the first contact adjusting wall 48 is pressed downward. As a result, the elastic contact piece 39 is not brought into contact with the tab terminal 41 in the mating connector 40.

If the first contact adjusting wall 48 passes the top inner wall 50 of the mating connector 40 by pressing the connector 47 further, as shown in FIG. 11C, the connector 47 becomes engaged completely horizontally. In this state, the tab terminal 41 of the mating connector 40 has invaded into the connector 47 and the elastic contact piece 39 is elastically in contact with the tab terminal 41. Thus, the sealed terminal 21 becomes conductive with the tab terminal 41.

As described above, according to this embodiment, it is possible to synchronize a complete engagement with the mating connector 40 with a contact state between the sealed terminal 21 and the tab terminal 41 by providing with the first contact adjusting wall 48 and the second contact adjusting wall 49. Thus, by detecting the complete engagement between the connectors 47 and 40, it is possible to detect the contact state between the sealed terminal 21 and the tab terminal 41, namely conductivity therebetween.

Next, a second embodiment of the terminal processing structure for the sealed wire and the terminal processing method for the same of the present invention will be described with reference to FIGS. 12 to 15.

According to this embodiment, the freedom of being applied to sealed wires each of which have a different diameter can be improved, in other words, versatility of the present invention to the sealed wires which vary in their diameters can be extended.

That is, according to this embodiment also, the communicating hole 35 is formed between the outer cover accommodating hole 33 and core accommodating hole 34 in the connector housing 20 like the first embodiment and the communicating hole 35 is surrounded by the shielding wall 36. Further, like the first embodiment, the shielding wall 36 is also tapered such that the diameter continuously decreases from the outer cover accommodating hole 33 to the core accommodating hole 34.

Figure 14:
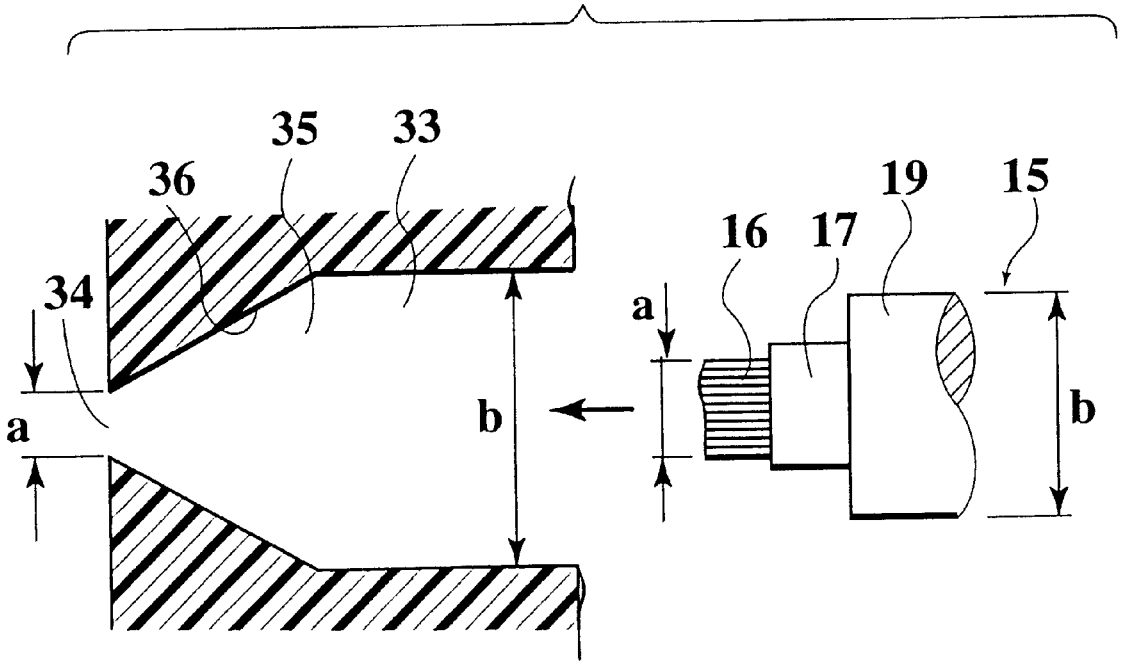
FIG. 14 is a diagram showing relation of dimensions between an outer cover accommodating hole and a core accommodating hole of the same embodiment.

However, this embodiment is characterized in that if the diameter of the core 16 of the broadest sealed wire 15, namely the maximum value of the diameter of the core 16 is "a" and the diameter of the insulating outer cover 19, namely the maximum value of the diameter of the insulating outer cover 19 is "b", as shown in FIG. 14, the diameter of the core accommodating hole 34 of the connector housing 20 is "a" and the diameter of the outer cover accommodating hole 33 is "b".

Figure 15A:
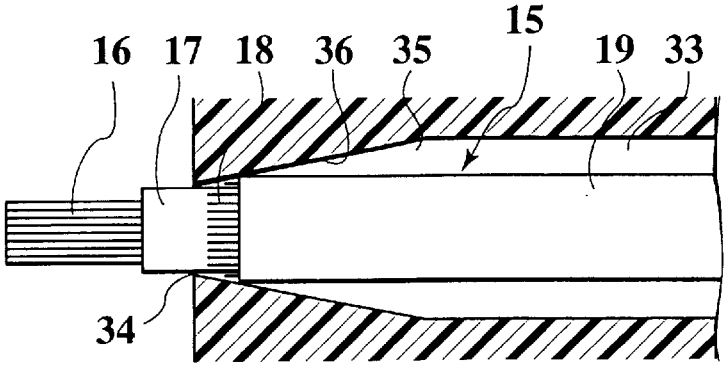
FIGS. 15A to 15D are partial sectional views showing an application to the sealed wires varying in thickness in the same embodiment.
Figure 15B:
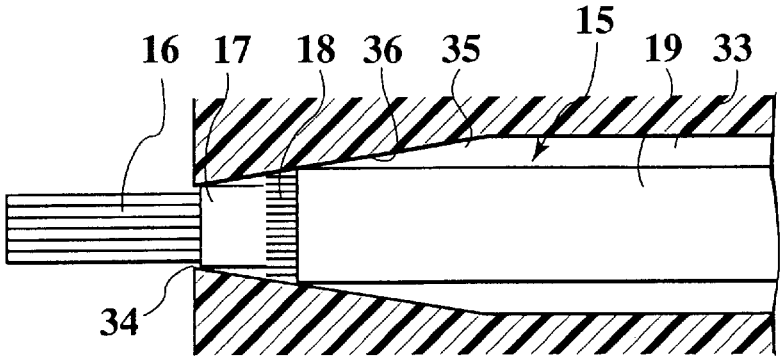
Figure 15C:
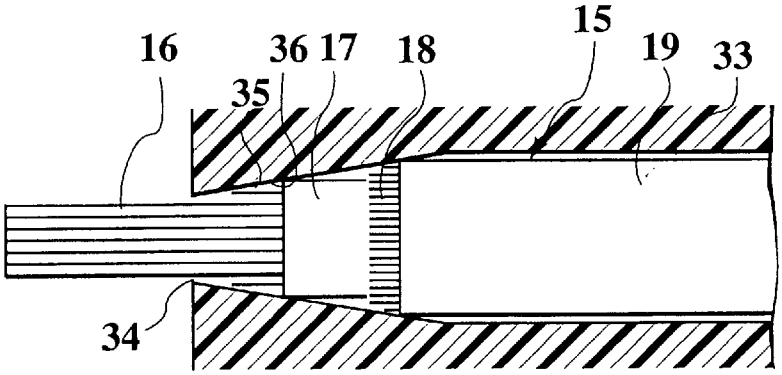
Figure 15D:
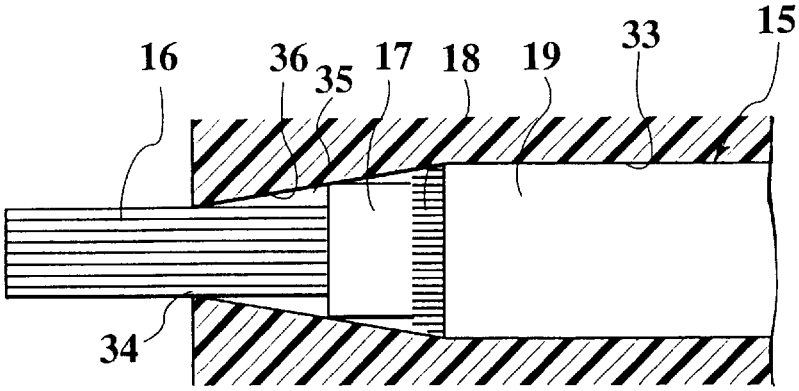

More concretely, if the broadest sealed wire 15 is used, as shown in FIG. 15D, the core 16 fills the core accommodating hole 34 and the insulating outer cover 19 fills the outer cover accommodating hole 33. Because the insulating inner cover 17 and braided wire 18 exposed by tearing the insulating outer cover 19 are located in the communicating hole 35 and the braided wire 18 at the uncovered portion is enclosed in the communicating hole 35 by the shielding wall 36, the braided wire 18 dose not come into contact with the core 16.

Figure 12:
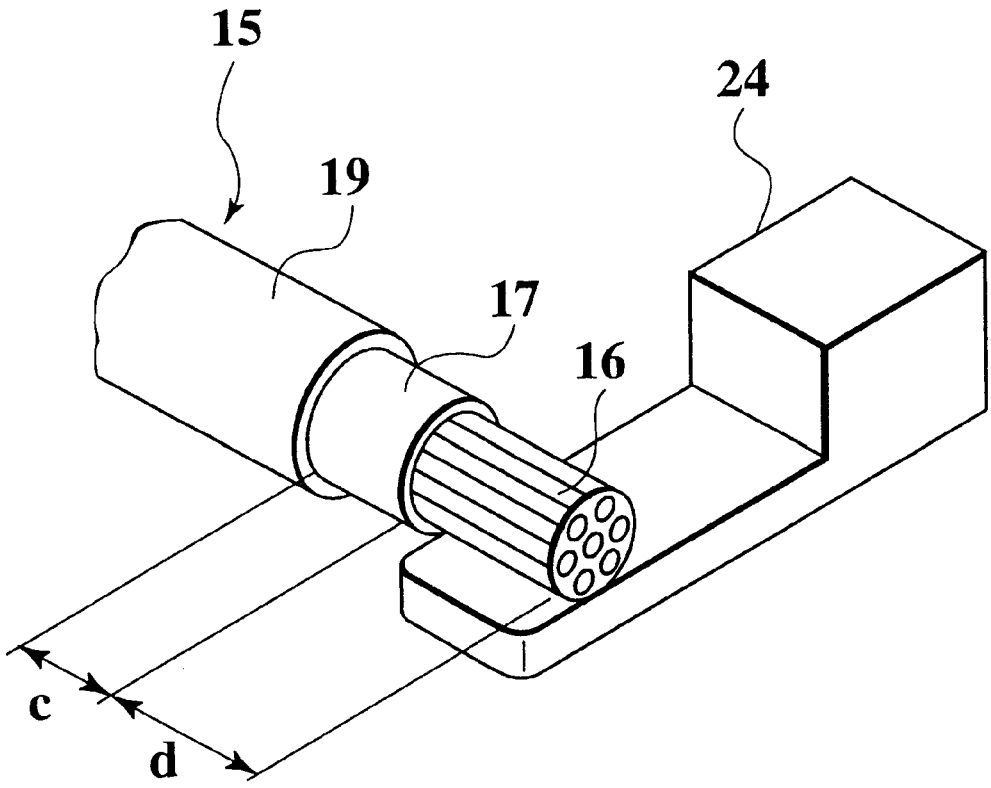
FIG. 12 is a perspective view showing relation of uncovering lengths in the sealed wire according to a second embodiment of the terminal processing structure for the sealed wire and terminal processing method for the same of the present invention.

On the other hand, in the case of the sealed wire 15 having a smaller diameter than the above mentioned one, the uncovering length "c" of the insulating inner cover 17 shown in FIG. 12 and the uncovering length "d" of the core 16 are adjusted corresponding to the diameter of the sealed wire 15.

Figure 13:
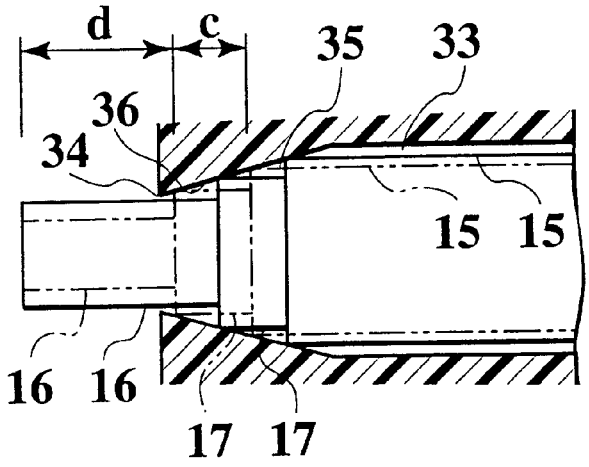
FIG. 13 is a partial sectional view showing relations of the dimensions regarding the uncovering lengths of the sealed wire according to the same embodiment.

Concretely, as shown in FIG. 13, this adjustment is carried out so that the insulating inner cover 17 is located within the communicating hole 35, namely within the shielding wall 36 with an end portion of the insulating inner cover 17 being in contact with the shielding wall 36 and the core 16 is located within the core accommodating hole 34. Therefore, as the diameter of the sealed wire 15 increases, that is, the diameter of the sealed wire 15 increases from a diameter indicated by a broken line in the figure to a diameter indicated by a solid line, the uncovering length "c" of the insulating inner cover 17 is set so that at least a periphery of an end of the insulating inner cover 17 is firmly in contact with the shielding wall 36 and the uncovering length "d" of the core 16 is set larger.

For example, FIG. 15C shows a case in which the sealed wire 15 is the second broadest and FIG. 15B shows a case in which the sealed wire 15 is the third broadest. In these figures, the insulating inner cover 17 and the core 16 are uncovered so that an end of the insulating inner cover 17 is firmly in contact with the shielding wall 36 and the core 16 is exposed longer, and the insulating inner cover 17 and the insulating outer cover 19 are located within the communicating hole 35. Thus, the braided wire 18 at the uncovered portion is encased in the communicating hole 35 by the shielding wall 36 so that the braided wire 18 dose not come into contact with the core 16.

FIG. 15A shows a case in which the sealed wire 15 has the smallest diameter. In this case, the core 16 is uncovered so that it is exposed short, and consequently, the braided wire 18 at the uncovered portion is encased in the communicating hole 35 by the shielding wall 36 so that the braided wire 18 does not come into contact with the core 16.

In FIGS. 15A to 15D, the length of the exposed insulating inner cover 17 is adjusted by considering an inclination angle of the shielding wall 36 of the communicating hole 35 so as to make the end portions of both the insulating inner cover 17 and the insulating outer cover 19 firmly contact the shielding wall 36. By such adjustment by uncovering, the insulating outer cover 19 is located within the communicating hole 35 so that the end portion of the insulating outer cover 19 is firmly in contact with the shielding wall 36 surrounding the communicating hole 35 and therefore the insulating outer cover 19 does not move further. Consequently, the braided wire 18 is securely held between the shielding wall 36 and the exposed insulating inner cover 17, so that the braided wire 18 is securely encased within the communicating hole 35, thereby making it possible to prevent the braided wire 18 from being in contact with the core 16.

As described above, the same connector housing can be applied to the sealed wires which vary in their diameters only by adjusting the uncovering lengths thereof depending on the diameters of the sealed wires. Thus, the versatility of the connector housing can be expanded.

Next, referring to FIGS. 16, 17A and 17B, a third embodiment of the terminal processing structure for the sealed wire and the terminal processing method for the same of the present invention will be described.

According to this embodiment, the outer cover accommodating hole 33, communicating hole 35 and core accommodating hole 34 formed in the main unit 28 of the connector housing 20 are structured such that they are arranged in the form of a staircase along the length direction which is the axial direction of the sealed wire 15. That is, as shown in FIGS. 16 and 17A, steps are formed between the outer cover accommodating hole 33 and core accommodating hole 34 so as to produce a first step 51 and a second step 52. These steps 51 and 52 construct the shielding wall.

Concretely, the first step 51 is located on the side of the outer cover accommodating hole 33 and the second step 52 is located on the side of the core accommodating hole 34. As for the first step 51, the insulating outer cover 19 is capable of passing within the outer cover accommodating hole 33, and the diameter of the communicating hole 35 is set to be smaller than the diameter of the insulating outer cover 19 and further, the diameter of the communicating hole 35 is set to be larger than the diameter of the insulating inner cover 17. As for the second step 52, the diameter of the core accommodating hole 34 is smaller than the diameter of the insulating inner cover 17 and as large as the core 16 is capable of passing through the core accommodating hole 34.

Figure 16:
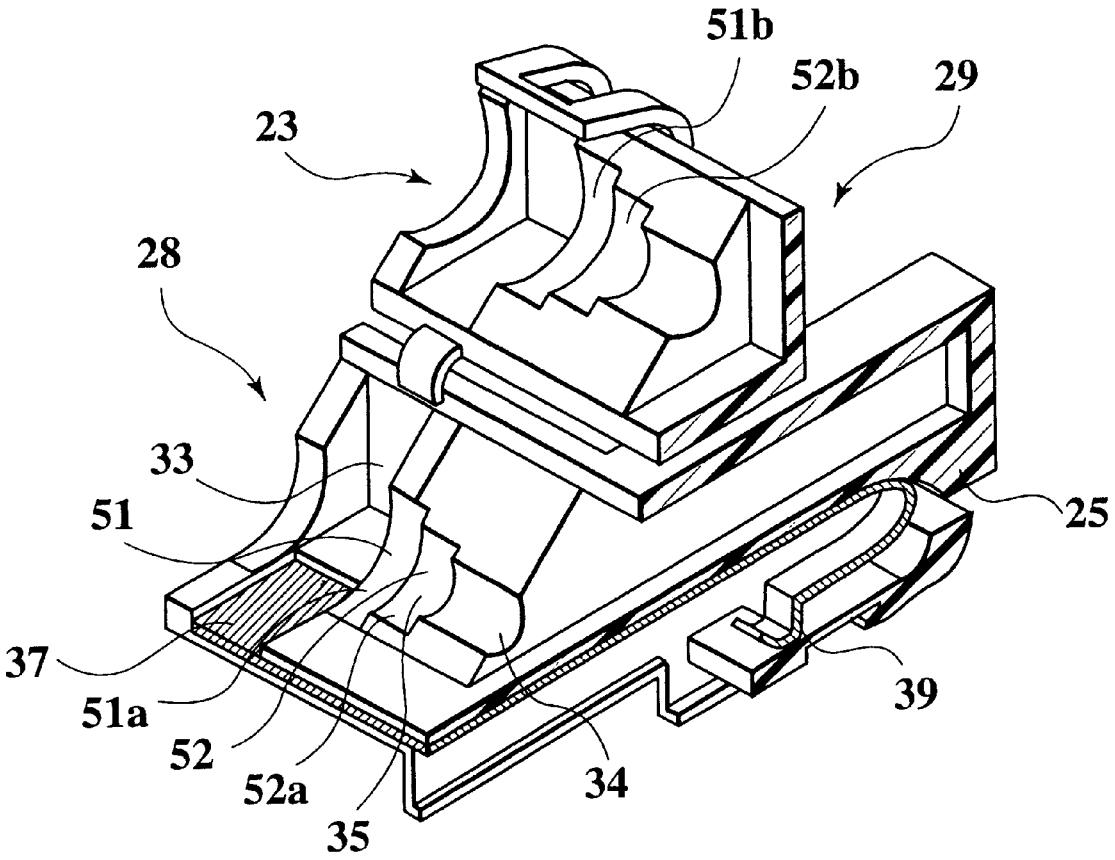
FIG. 16 is a perspective view including a part of section of the connector housing with the cover opened according to a third embodiment of the terminal processing structure for the sealed wire and terminal processing method for the same of the present invention.

According to this embodiment, to form such steps 51, 52, half cut portions 51*a*, 51*b*, 52*a* and 52*b* are formed in the main unit 28 and cover 29 as shown in FIG. 16.

Figure 17A:
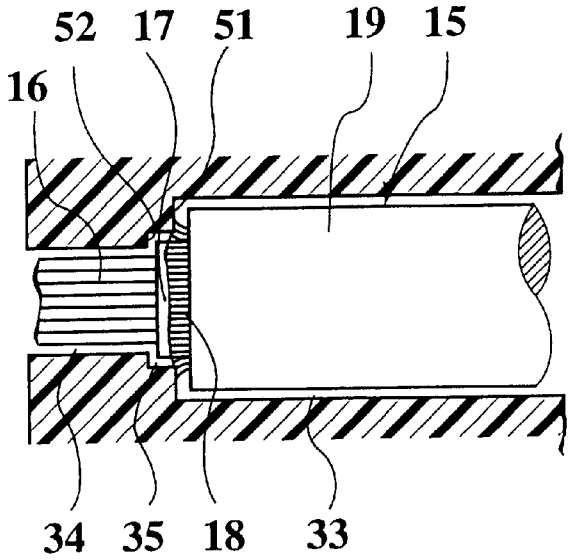
FIG. 17A is a partial sectional view for explaining anoperation of the same embodiment.
Figure 17B:
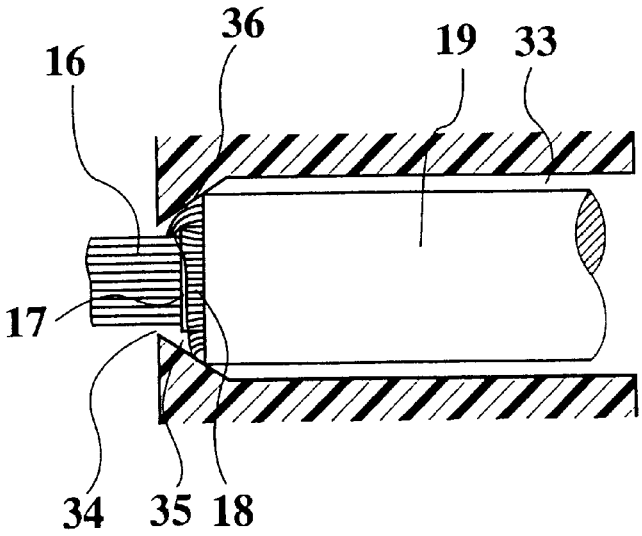
FIG. 17B is a partial sectional view for explaining by comparing the operation of the same embodiment with the first embodiment.

As regards the steps 51 and 52 constructing the shielding wall, as shown in FIG. 17A, the sealed wire 15 is fixed in the condition that the insulating inner cover 17 is in contact with a vertical wall of the second step 52 and the insulating outer cover 19 is in contact with a vertical wall of the first step 51. Thus, the braided wire 18 exposed at the uncovered portion of the insulating outer cover 19 does not come out of the communicating hole 35 to the side of the core 16, so that it dose not come into contact with the core 16. In FIG. 17A, for convenience of graphic representation, relations between these vertical walls and the end of the insulating outer cover 19 and the end of the insulating inner cover 17 are expressed each with a small gap therebetween.

Further, according to this embodiment, the steps 51 and 52 are capable of absorbing a deviation of dimensional error of the uncovering length of the sealed wire 15, thereby preventing an unfavorable event due to such deviation of the dimension. That is, in the structure of the first embodiment, the sealed wire 15 deviates in position due to the deviation of the uncovering length as shown in FIG. 17B, so that the braided wire 18 may come into contact with the core 16. However, in this embodiment, the steps 51 and 52 prevent this phenomenon, thereby making it possible to achieve a further reliable insulation.

Then, a modification of this embodiment reflecting the structure described about the second embodiment will be described.

Such a modification expands the versatility of this invention to a plurality of the sealed wires 15 which vary in their diameters like the second embodiment.

Figure 18A:
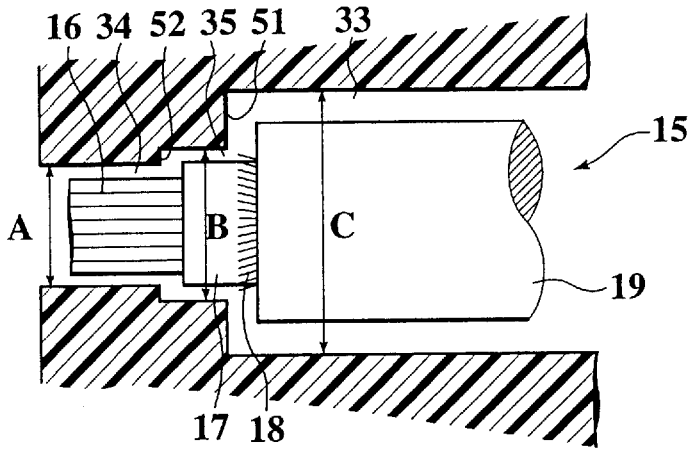
FIG. 18A is a partial sectional view showing relation of dimensions between the core accommodating hole, communicating hole and outer cover accommodating hole of the same embodiment.
Figure 18B:
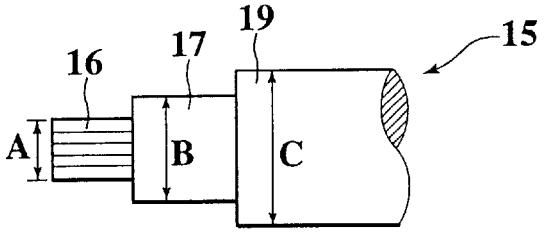
FIG. 18B is a diagram showing relation of dimensions in the sealed wire corresponding to FIG. 18A.

Concretely, if the diameter of the core 16 of the broadest sealed wire 15, namely the maximum value of the diameter of the core 16 is "A", the diameter of the insulating inner cover 17 of the broadest sealed wire 15, namely the maximum value of the diameter of the insulating inner cover 17 is "B" and then the diameter of the insulating outer cover 19 of the broadest sealed wire 15, namely, the maximum value of the diameter of the insulating outer cover 19 is "C" as shown in FIG. 18B, the diameter of the core accommodating hole 34 is set to "A", the diameter of the communicating hole 35 between the steps 52 and 51 is set to "B" and the diameter of the outer cover accommodating hole 33 is set to "C" as shown in FIG. 18A.

Because in such a structure, the diameter of the core accommodating hole 34, the diameter of the communicating hole 35 between the steps 51 and 52 and the diameter of the outer cover accommodating hole 33 are determined corresponding to the dimensions of the broadest sealed wire, this structure can be applied to sealed wires smaller than the broadest sealed wire, and those sealed wires are also held securely by the steps thereby shielding the braided wire 18 securely from the core 16 so as to achieve insulation. For convenience of graphic representation, a relation between the vertical wall and the end portion of the insulating outer cover 19 and a relation between the vertical wall and the end portion of the insulating inner cover 17 are expressed each with a slight gap therebetween.

Figure 19:
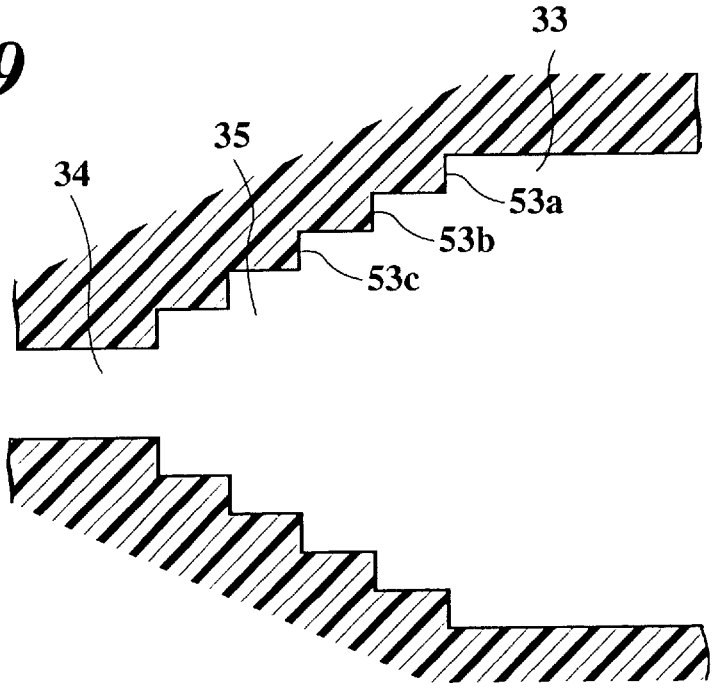
FIG. 19 is a sectional view including a plurality of steps for application to the plurality of the sealed wires varying in thickness according to the same embodiment.

Further, in case a plurality of the sealed wires which vary in their diameters are used, it is preferable that the above mentioned setting is carried out for each of the plurality of the sealed wires, as shown in FIG. 19.

Concretely, plural steps 53*a*, 53*b*, 53*c* . . . are formed from the outer cover accommodating hole 33 to the core accommodating hole 34 as the diameter of the communicating hole 35 decreases by step. In other words, these plural steps 53*a*, 53*b*, 53*c* . . . construct the communicating hole 35. By forming the plural steps like this case, the freedom of being applied to the sealed wires which vary in their diameters can be expanded thereby the versatility being improved.

Figure 20A:
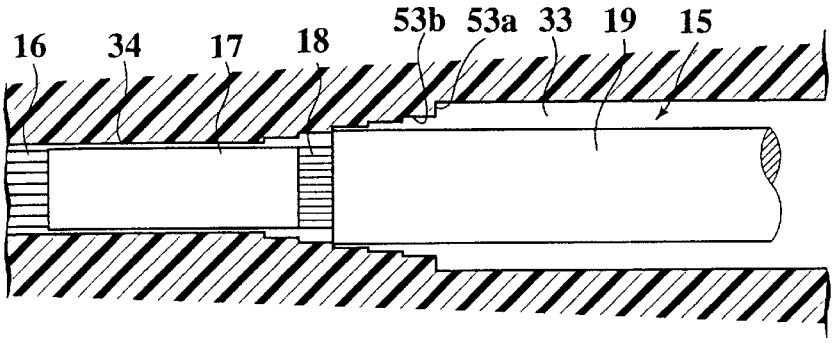
FIGS. 20A to 20D are partial sectional views showing application to the sealed wires varying in thickness according to the same embodiment.
Figure 20B:
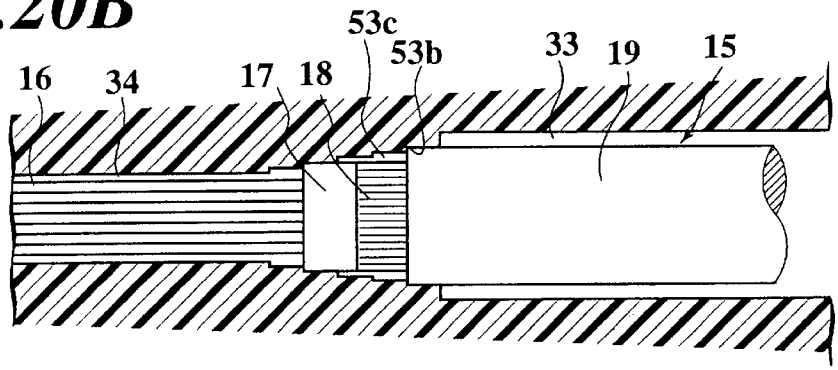
Figure 20C:
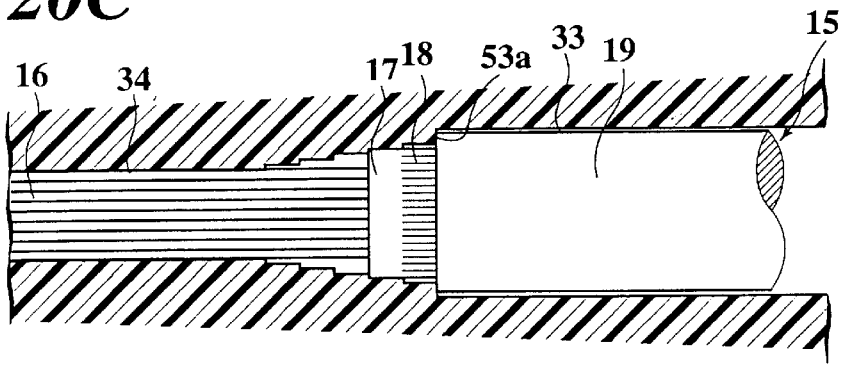
Figure 20D:
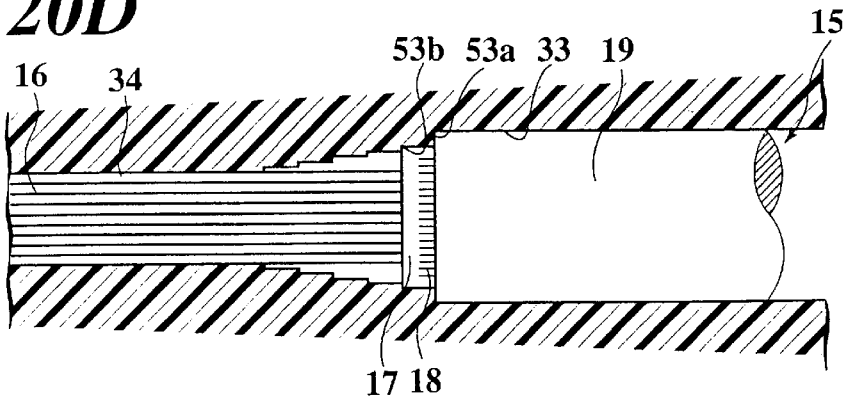

FIGS. 20A to 20D show examples of application to the sealed wire 15 in case such plural steps 53*a*, 53*b*, 53*c* . . . are formed. FIG. 20A shows a case in which the sealed wire 15 having the smallest diameter is applied, FIG. 20D shows a case in which the sealed wire 15 having the largest diameter is applied, and FIGS. 20B and 20C show cases in which the sealed wire of medium size is applied. In any case, the sealed wire 15 is held by a corresponding step so that it does not move, and therefore the braided wire 18 can be shielded from the core 16 securely so as to achieve insulation.

In this embodiment, the core accommodating hole 34 has a predetermined length in the length direction which is the axial direction of the sealed wire 15. The core accommodating hole 34 of the first embodiment and second embodiment may be provided with such a structure as required.

Figure 21:
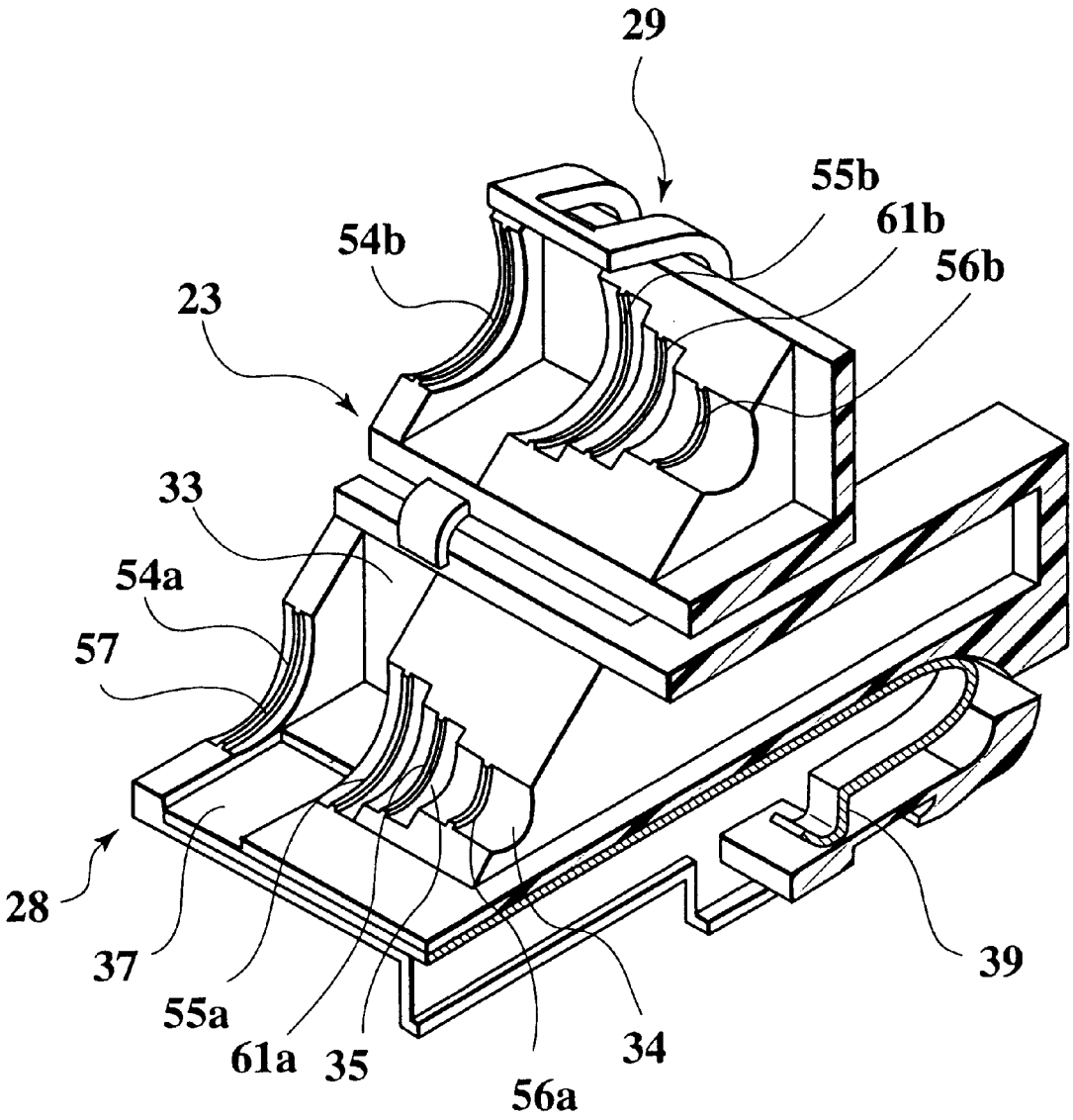
FIG. 21 is a perspective view including a part of section of the connector housing with the cover opened according to a fourth embodiment of the terminal processing structure for the sealed wire and terminal processing method for the same of the present invention.
Figure 22A:
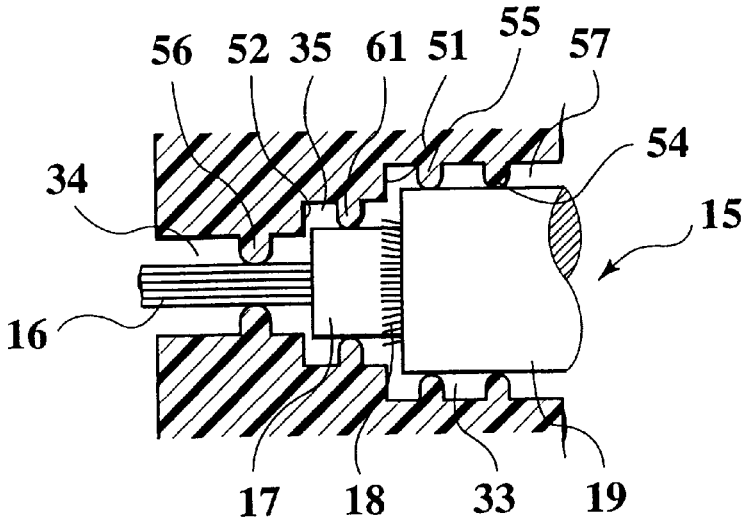
FIG. 22A is a partial sectional view in the same embodiment.
Figure 22B:
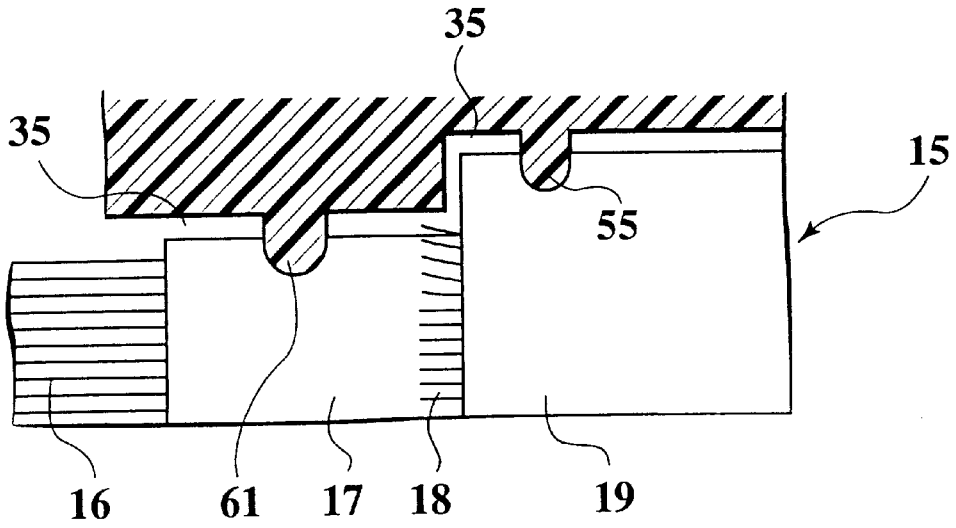
FIG. 22B is a partially enlarged sectional view of FIG. 22A.

Finally, a fourth embodiment of the terminal processing structure for the sealed wire and the terminal processing method for the same of this invention will be described with reference to FIGS. 21 22A and 22B.

In this embodiment, in addition to the structure of the third embodiment, a plurality of protrusions 54, 55, 56 and 61 are formed.

Concretely, the first protrusion 54 is formed in a nipping hole 57 to the sealed wire 15, the second protrusion 55 is formed in the outer cover accommodating hole 33 in which the step 51 is formed, the third protrusion 61 is formed in the communicating hole 35 in which the step 52 is formed, and the fourth protrusion 56 is formed in the core accommodating hole 34. These protrusions 54, 55, 61 and 56 are formed with the half cut portions 54*a*, 55*a*, 61*a*, 56*a* and the half cut portions 54*b*, 55*b*, 61*b*, 56*b* as shown in FIG. 21. By putting the cover 29 on the main unit 28, they become protrusions projecting in a ring-like shape as shown in FIG. 22A.

Because each of the protrusions 54, 55, 61 and 56 have a shape of projecting to the sealed wire 15, they bite in a corresponding position of the sealed wire 15. Speaking in detail, as shown in FIG. 22B, the second protrusion 55 bites in the peripheral surface of the insulating outer cover 19, and the third protrusion 61 bites in the peripheral surface of the insulating inner cover 17. Although not shown, the first protrusion 51 bites in the peripheral surface of the insulating outer cover 19 and the fourth protrusion 56 bites in the core 16. Because of the biting of each of the protrusions 54, 55, 61 and 56, the sealed wire 15 dose not deviate in position thereby preventing a contact between the braided wire 18 and core 16 due to that deviation. Further, when the cover 29 is put on the main unit 28, the sealed wire 15 can be fastened securely.

Figure 23:
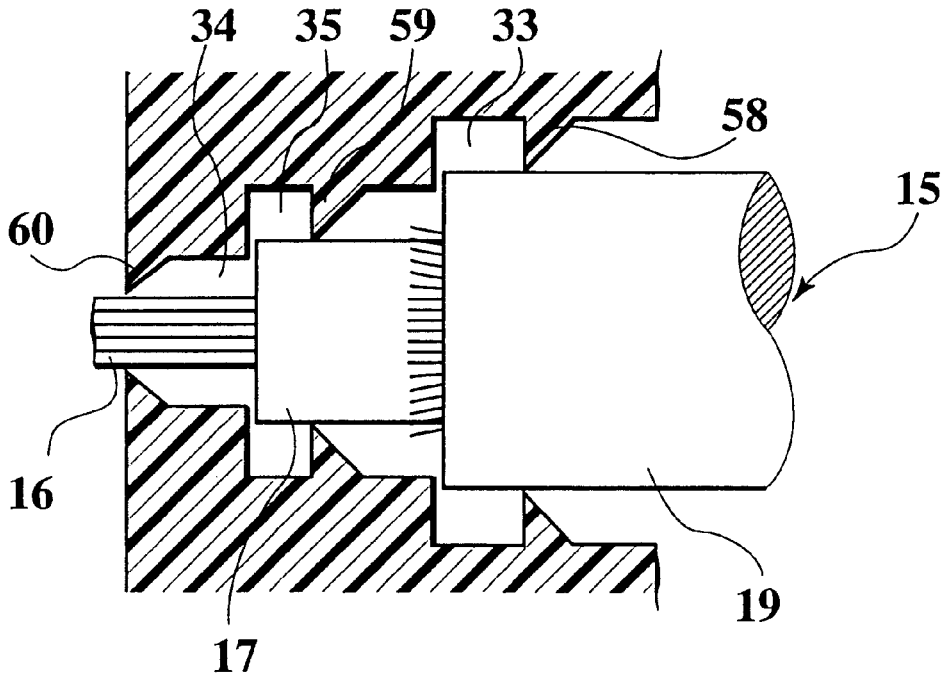
FIG. 23 is a partial sectional view of a modification of the same embodiment.

FIG. 23 shows a modification of the protrusion according to this embodiment. The plurality of the protrusions 58, 59 and 60 according to this modification are formed such that their sides facing the outer cover accommodating hole 33 are inclined. The protrusions 58, 59 and 60 respectively bite the insulating outer cover 19, insulating inner cover 17 and core 16 to prevent the insulating outer cover 19, insulating inner cover 17 and core 16 from slipping out, namely to prevent the sealed wire 15 from moving to the right in FIG. 23. Because of the biting of the insulating outer cover 19, insulating inner cover 17 and core 16, not only the sealed wire 15 is fixed and blocked from deviating, but also the sealed wire 15 is securely blocked from slipping out because a resistance occurs in a direction for preventing the sealed wire 15 from slipping out, so that the sealed wire 15 can be fixed in stable.

What is claimed is:

1. A terminal processing structure for a sealed wire, said sealed wire having a core, an insulating inner cover covering said core, a braided wire disposed around said insulating inner cover and an insulating outer cover covering said braided wire, said core being capable of being exposed by tearing off said insulating inner cover, and said braided wire being capable of being exposed by tearing off said insulating outer cover, comprising:

a terminal to which said core exposed by tearing off said insulating inner cover is to be connected;

a connector housing in which said sealed wire is disposed therein, said sealed wire having said core exposed by tearing off said insulating inner cover and said braided wire exposed by tearing off said insulating outer cover, and said core exposed by tearing off said insulating inner cover being connected to said terminal; and wherein the connector housing includes a shielding wall configured to shield and insulate between said exposed core and said exposed braided wire.

2. A terminal processing structure for a sealed wire according to claim 1, wherein said connector housing further comprises a core accommodating hole accommodating said core exposed by tearing off said insulating inner cover and an outer cover accommodating hole accommodating said insulating outer cover, said shielding wall being disposed between said core accommodating hole and said outer cover accommodating hole.

3. A terminal processing structure for a sealed wire according to claim 1, wherein said shielding wall is firmly in contact with a periphery of an end portion of said insulating inner cover and/or a periphery of an end portion of said insulating outer cover.

4. A terminal processing structure for a sealed wire according to claim 2, wherein said shielding wall has a tapered shape whose diameter continuously decreases from said outer cover accommodating hole to said core accommodating hole.

5. A terminal processing structure for a sealed wire according to claim 2, wherein said shielding wall has a staircase shape whose diameter stepwise decreases from said outer cover accommodating hole to said core accommodating hole.

6. A terminal processing structure of a sealed wire according to claim 2, wherein said sealed wire includes a plurality of sealed wires varying in size, a diameter of said core accommodating hole corresponds to a maximum value among diameters of cores in said plurality of sealed wires to be disposed in said connector housing, a diameter of said outer cover accommodating hole corresponds to a maximum value among diameters of insulating outer covers in said plurality of sealed wires to be installed in said connector housing, and a tearing length of said insulating inner cover and/or said tearing length of said insulating outer cover are adjusted corresponding to size of each of said plurality of said sealed wires.

7. A terminal processing structure of a sealed wire according to claim 1, wherein said shielding wall has protrusions biting in said core, on a peripheral surface of said insulating inner cover, and/or on a peripheral surface of said insulating outer cover.

8. A terminal processing structure of a sealed wire according to claim 7, wherein a face of said protrusion on a side of said insulating outer cover is inclined.

9. A terminal processing structure of a sealed wire according to claim 1, wherein said connector housing is formed of a main unit having a lower half of said shielding wall and a cover having a upper half of said shielding wall and to be put on said main unit.

10. A terminal processing structure of a sealed wire according to claim 1, further comprising a sealed terminal, wherein said sealed terminal has an elastic contact piece elastically in contact with a mating tab terminal of a mating connector which said connector housing engages, said connector housing having contact adjusting walls avoiding a contact between said elastic contact piece and said mating tab terminal in a case of incomplete engagement with said mating connector and permitting a contact between said elastic contact piece and said mating tab in a case of complete engagement with said mating connector.

11. A terminal processing structure of a sealed wire according to claim 1, wherein said terminal is disposed in said connector housing in a direction perpendicular to an installation direction of said sealed wire.

12. A terminal processing structure of a sealed wire according to claim 1, wherein said braided wire and a sealed terminal are conductively connected to each other by applying ultrasonic vibration to said insulating outer cover from outside of said connector housing.

13. A terminal processing method for a sealed wire, comprising the steps of:

preparing a terminal;

exposing said core by tearing off said insulating inner cover;

exposing said braided wire by tearing off said insulating outer cover;

connecting said sealed wire to said terminal by connecting said core exposed by tearing off said insulating inner cover to said terminal; and providing said sealed wire connected to said terminal within a connector housing such that said sealed wire is overlaid between a core accommodating hole of said connector housing and an outer cover accommodating hole of said connector housing so that a shielding wall of said connector housing shields and insulates between said exposed core and said exposed braided wire.

14. A terminal processing method for a sealed wire according to claim 13, further comprising the step of:

adjusting said tearing length of said insulating inner cover and/or said tearing length of said insulating outer cover based on a size of said sealed wire.

15. A terminal processing structure of a sealed wire according to claim 9, wherein the lower half of said shielding wall includes a lower half of a core accommodating hole and a lower half of a outer cover accommodating hole, and the upper half of said shielding wall includes an upper half of the core accommodating hole and an upper half of the outer cover accommodating hole.

16. A terminal processing method for a sealed wire according to claim 13, further comprising the step of:

clamping the shielding wall to a periphery of an end portion of said insulating inner cover and/or to a periphery of an end portion of said insulating outer cover.

17. A terminal processing method for a sealed wire according to claim 13, further comprising the step of:

providing a shielding wall having a tapered shape whose diameter continuously decreases from said outer cover accommodating hole to said core accommodating hole.

18. A terminal processing method for a sealed wire according to claim 13, further comprising the step of:

providing a shielding wall having a staircase shape whose diameter stepwise decreases from said outer cover accommodating hole to said core accommodating hole.

19. A terminal processing method for a sealed wire according to claim 13, further comprising the steps of:

inserting a sealed terminal having an elastic contact piece into said connector housing; and inserting a mating connector into said connector housing such that the elastic contact piece elastically contacts the mating connector.

20. A terminal processing method for a sealed wire according to claim 19, further comprising the step of providing the connector housing with contact adjusting walls for avoiding contact between the connector housing and the mating tab terminal when the mating connector incompletely engages the connector housing and for permitting contact between the connector housing and the mating tab terminal when the mating connector completely engages the connector housing.

21. A terminal processing method for a sealed wire according to claim 13, further comprising the step of applying ultrasonic vibration to said insulating outer cover from outside of said connector housing so as to conductively connect said braided wire to a sealed terminal.

* * * * *

UNITED STATES PATENT AND TRADEMARK OFFICE

CERTIFICATE OF CORRECTION

PATENT NO. : 6,059,603
DATED : May 9, 2000
INVENTOR(S) : Sato et al.

It is certified that error appears in the above-identified patent and that said Letters Patent is hereby corrected as shown below:

Claim 9, column 15,
Line 62, "a upper", should read -- an upper --.

Claim 15, column 16,
Line 43, "a outer", should read -- an outer --.

Signed and Sealed this

Twenty-eighth Day of August, 2001

*Attest:*

Nicholas P. Godici

NICHOLAS P. GODICI
*Acting Director of the United States Patent and Trademark Office*

*Attesting Officer*